United States Patent [19]

Reeve, Jr. et al.

[11] 3,942,593

[45] Mar. 9, 1976

[54] DRILL RIG APPARATUS

[75] Inventors: John R. Reeve, Jr.; Ralph Busse; Elbert Walker; Raymond L. Welch; Hermus C. Moore, Jr.; Milton P. Jones, all of Pampa, Tex.

[73] Assignee: Cabot Corporation, Boston, Mass.

[22] Filed: Oct. 17, 1973

[21] Appl. No.: 407,098

[52] U.S. Cl. ..... 173/23; 52/118; 173/151; 175/85; 211/60 S

[51] Int. Cl.[2] ..... E21B 7/02

[58] Field of Search ..... 52/116–121; 173/151, 23; 175/85; 254/139.1; 211/60 S

[56] References Cited

UNITED STATES PATENTS

| | | | |
|---|---|---|---|
| 2,632,631 | 3/1953 | Griffin et al. | 175/216 X |
| 2,679,910 | 6/1954 | Moore | 52/116 |
| 2,887,191 | 5/1959 | Lovell | 52/119 X |
| 2,993,570 | 7/1961 | Bender | 52/118 |
| 3,016,992 | 1/1962 | Wilson | 52/118 X |
| 3,033,527 | 5/1962 | Wilson | 52/116 X |
| 3,101,816 | 8/1963 | Fox | 254;52/139.1 X;118 |
| 3,136,394 | 6/1964 | Woolslayer et al. | 52/119 X |
| 3,245,180 | 4/1966 | Bules et al. | 52/116 |
| 3,280,520 | 10/1966 | Woolslayer | 254/139.1 X |
| 3,333,377 | 8/1967 | Woolslayer | 52/116 |
| 3,365,008 | 1/1968 | Zimmerman et al. | 52/120 X |
| 3,739,853 | 6/1973 | Wales | 52/116 X |
| 3,747,695 | 7/1973 | Branham | 173/151 |
| 3,754,361 | 8/1973 | Branham et al. | 52/115 |
| 3,807,109 | 4/1974 | Jenkins | 175/173 X |
| R25,010 | 7/1961 | Poetker | 52/119 |

*Primary Examiner*—Frank L. Abbott
*Assistant Examiner*—William F. Pate, III
*Attorney, Agent, or Firm*—Kenneth W. Brown; Barry R. Blaker; Lawrence A. Chaletsky

[57] ABSTRACT

There is disclosed herein a mobile well drilling rig apparatus adapted for rapid assembly and disassembly thereof. The drilling rigs of the invention comprise a trailerable telescoping mast assembly and a separate sectionable substructure assembly therefor comprising a rig base, a working floor mounted in spaced relation above the base and a rig base extension extending outwardly from the drawworks side of the rig base. In a preferred embodiment, rail means defining a mastway are provided between the erected working floor and the rig base extension. The base mast section of the telescoping mast assembly is provided with cooperative mast roller means whereby the base of the mast structure is readily conveyed to the working floor and whereby the drawworks side mast legs are engaged into a trunnion arrangement therefor. Means are also provided for raising of the mast structure to the vertical from the drawworks side of the rig.

31 Claims, 13 Drawing Figures

DRILL RIG APPARATUS

FIELD OF THE INVENTION

The present invention relates generally to drilling rigs and is more specifically concerned with mobile oil well drilling rigs.

In recent years, due in large measure to ever increasing operating costs and to the so-called "energy crisis", it has become vital to provide mobile drilling rigs adapted for roading and for rapid assembly and disassembly thereof at the well site, thereby to maximize productive on-site drilling time while minimizing essentially non-productive erection, disassembly and roading time. Heretofore, mobile drilling rigs have generally comprised a four-legged disassembleable or telescoping mast assembly having one open "V-door" side, which assembly is erected to the working floor of the rig from the so-called "V-door" side thereof. Firstly, the mast assemblies of the prior art normally require unstringing and removal of the travelling block cables and travelling block prior to lowering the mast from the drill rig or at least prior to disassembly or telescoping of the mast preparatory to moving on to a new well site. This, of course, requires the expenditure of substantial time and labor both in unstringing at the old well site and in restringing of the travelling and mast crown blocks at the new well site as well as in the assembly and disassembly of the mast. Also, erection of the mast assemblies of the prior art mobile drilling rigs from the V-door side of the working floor of the rig also tends to delay start-up of drilling operations since the drill-pipe cannot be moved into a suitable ground position for racking thereof until such time as the mast is raised to the vertical and the pipe racking ground area is cleared. Further, the access road to a drilling rig normally courses directly up to the drawworks side thereof. Thus, particularly where the intended well site is located on marshy ground, it is normally necessary to expend substantial time and effort in grading and stabilizing a substantial ground area completely around the rig in order to provide access and working area for the necessarily heavy equipment required to move and erect the mast from the V-door side of the rig. In accordance with the present invention, these and other problems associated with conventional mobile drilling rig apparatuses of the prior art have been substantially completely eliminated or at least substantially ameliorated.

OBJECTS OF THE INVENTION

It is a principal object of the invention to provide a novel mobile drill rig assembly.

It is another object of the invention to provide a mobile drill rig assembly which is rapidly erected and dismantled at the well site.

It is yet another object of the invention to provide a drill rig assembly having good wind stability.

It is another object of the invention to provide a drill rig assembly whereby the working floor thereof is trailerable while assembled to the rig base and which working floor can be rapidly erected to its working height at the well site.

It is another object of the invention to provide a drill rig assembly whereby provision is made for carrying and moving a blowout preventer into position over the well hole.

It is still another object of the invention to provide a drill rig assembly having improved means for adjusting and maintaining the mast structure thereof in a plumb condition.

It is another object of the invention to provide a novel telescoping mast assembly which is itself a trailer.

It is another object of the invention to provide a novel trailer telescoping mast assembly for drill rigs which may be maintained in the rigged and strung condition during telescoping and trailering thereof.

It is still another object of the invention to provide a telescoping mast assembly for drill rigs wherein concentric loading through adjacent mast leg sections is achieved, thereby to provide improved structural rigidity and straightline transfer of compression loads throughout substantially the entire length of the erected mast assembly.

It is another object of the invention to provide a trailer telescoping mast assembly for drill rigs wherein excessive torquing of the respective mast sections thereof during telescoping operations is avoided by a novel kingpin/fifth wheel arrangement which isolates the mast sections from tractor vehicle induced torquing loads.

Other objects and advantages of the present invention will in part be obvious and will in part appear hereinafter.

SUMMARY OF THE INVENTION

In accordance with the present invention, drill rig apparatus is provided broadly comprising a trailer telescoping mast assembly and a trailerable substructure assembly comprising a rig base and a working floor mounted in spaced relation above the surface of said base. The rig base includes an extension which extends outwardly from the drawworks side of the rig, preferably defining a "T"-shaped rig base planform, the leg section defined by said extension providing a platform upon which a trailer or self-propelled drawworks/rotary table power group vehicle may be stationed. Bracing elements extend diagonally upwardly from the rig base extension to the drawworks side of the working floor. In a preferred embodiment, said rig base extension is provided with a diagonally upwardly directed mastway extending to the drawworks side of the working floor.

The telescoping mast assembly forming part of the drill rig assembly of the invention is adapted for trailering with the open or "V-door" side thereof on the top. The lower ends of the pair of mast leg members located on the drawworks side of the base mast section are equipped with means adapted to provide vertically pivotal engagement thereof with corresponding trunnions located on the drawworks side of the working floor of the substructure assembly. Additionally, the base mast section is preferably provided with track rollers which engage cooperatively with the preferred mastway of the substructure assembly. Upon telescoping and securing of the mast assembly into its extended and trailered condition, the base mast section thereof is rolled upwardly on the mastway and the trunnion engaging means of the lower ends of the pair of drawworks side leg members of the base mast section are mated and pinned to their corresponding trunnion blocks located on the working floor of the substructure assembly. Raising means, located on the drawworks side of the rig, are provided to raise the mast assembly to the vertical. Said raising means may take the form of a pair of hydraulic raising rams each of which may be carried attached at one end to respective drawworks side leg members of the base mast section during roading and which are secured at their opposite ends for mast raising and lowering purposes to the rig base extension. Upon raising of the mast, the drill rig assembly is completed by stationing a trailered or self-propelled drawworks/rotary table power group into position on the rig base extension.

THE DRAWINGS

FIG. 11 depicts suitable means for vertical adjustment of the drawworks side mast legs.

DESCRIPTION OF PREFERRED EMBODIMENTS

Figure 1:
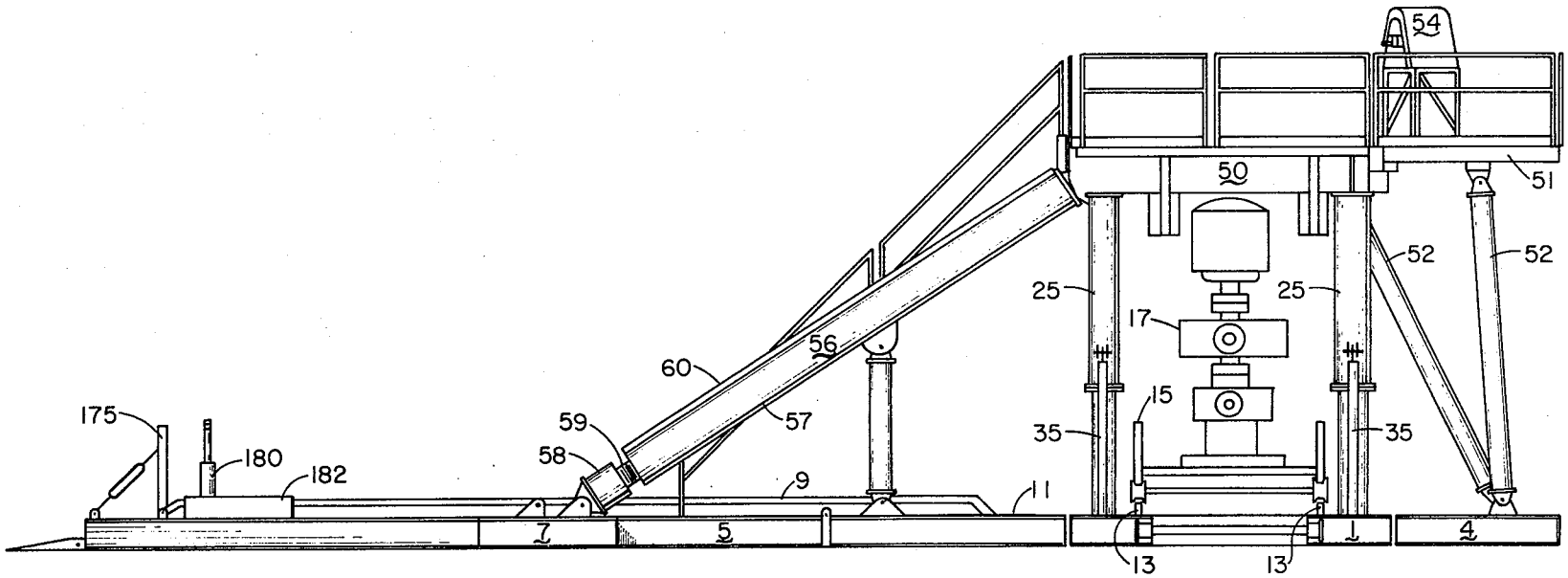
FIG. 1 is a schematic, diagrammatic side view of a substructure assembly of the invention showing several preferred embodiments thereof.
Figure 2:
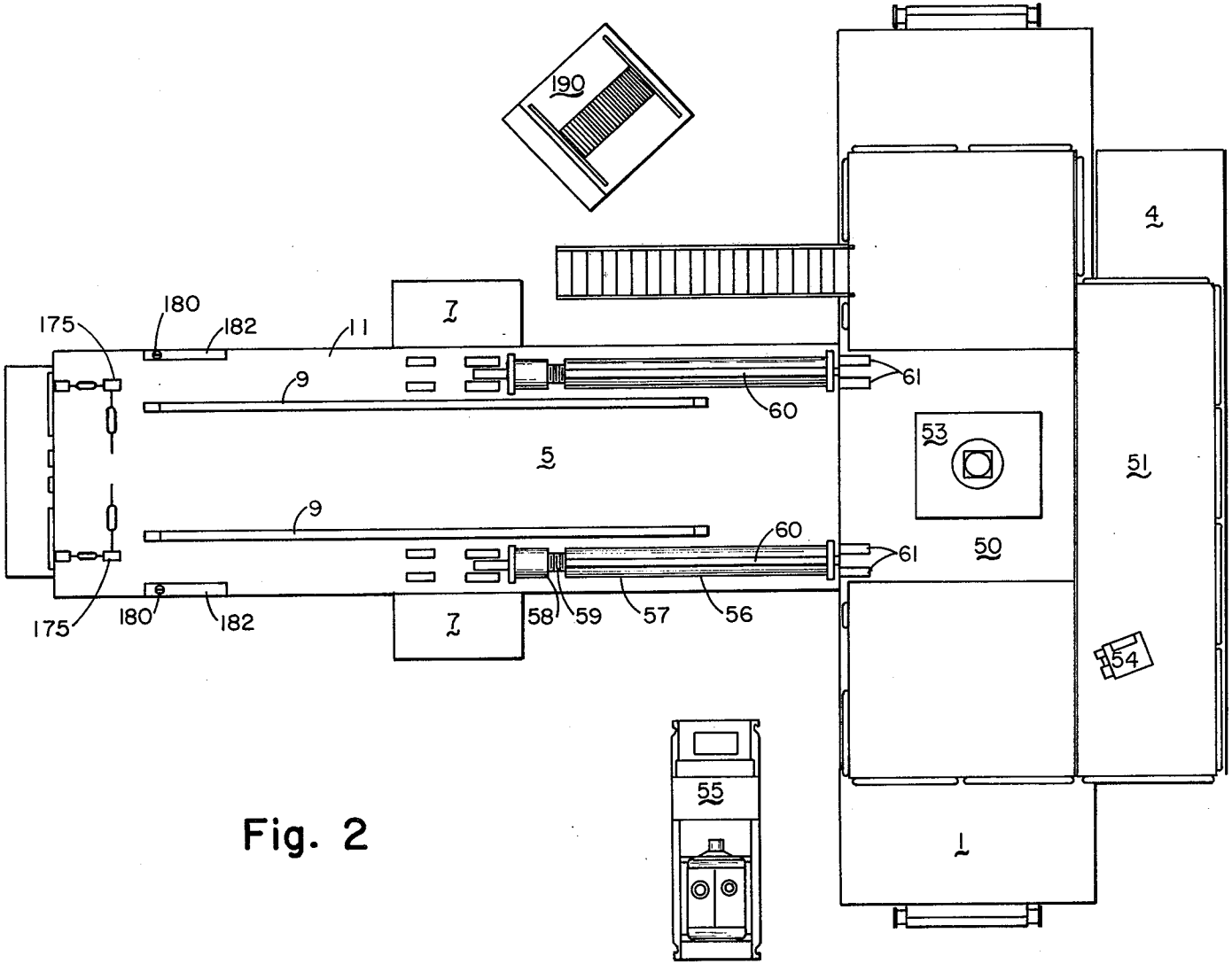
FIG. 2 is a schematic, diagrammatic plan view of the substructure assembly of FIG. 1 and includes in the depiction thereof a suitable layout for the positioning of a reserve line spool and a hydraulic power package.

Reference is now made to the drawings, wherein like reference numerals refer to like structures. With especial reference to FIGS. 1 and 2, the substructure assembly forming part of the overall drill rig assembly of the invention broadly comprises a rig base 1 and a working floor 50 spaced above rig base 1.

Rig base 1, in the assembled state, additionally comprises a substantial rig base extension 5 which extends outwardly from the drawworks side of the rig. Accordingly, in the plan view of FIG. 2, rig base 1 defines a generally "T"-shaped structure with the rig base extension 5 of said structure constituting the leg of the T. By adherence to this basic T-shaped rig base geometry there is generally minimized the total number of trailerable sections required to form the substructure assembly and, of course, this contributes to minimizing the roadable weight of the overall drill rig assembly of the invention. Further benefits accruable to the use of a generally T-shaped rig base 1 will be discussed in more detail hereinafter. In other preferred embodiments relating to the rig base 1, rig base extension 5 is provided with outriggers 7 at locations whereat heavy load concentrations are likely to be encountered. Said rig base extension 5 is also desirably provided with a pair of parallel spaced apart guideways 9. The distance between said guideways 9 is chosen so as to result in their engagement with the tire arrangement of the bogie employed in trailering of the mast assembly of the invention and of the tire arrangement of the trailer or self-propelled drawworks/rotary table power group employed in the drill rig assemblies of the invention. Said guideways 9, therefore, act as positioning devices while moving the mast assembly or power group units into their respective erection or operating positions on the drill rig assembly. Conveniently, said guideways 9 can generally be each of welded pipe construction and can be permanently affixed, such as by welding, to the plate steel surface 11 of rig base extension 5. It is also highly desirable to provide rig base 1, underlying the working floor 50, with a tracked dolly arrangement comprising tracks 13 and dolly 15, said dolly 15 being adapted to hold therein a suitable blowout preventer 17. Obviously, the tracks 13 should embrace and extend over the well hole site in order that the blowout preventer dolly 15 may be positioned over the well for placement of the blowout preventer. The trackway 13 can run laterally to either side of the well hole site or can run toward the V-door side of the rig base 1. In this manner, the blowout preventer 17 may be conveniently stored adjacent the well hole during rig moves.

The working floor 50 is supported spaced above the rig base 1 by means of suitable support members 25. Desirably, said support members 25 are of telescoping construction, thereby to provide substantial savings in erection time of the substructure assembly and to avoid requirement for disassembly of the working floor 50 from the rig base 1 for purposes of trailering. Accordingly, in a much preferred embodiment of the invention, the substructure assembly will comprise a rig base 1, working floor 50 and a number of telescoping support members 25 interposed therebetween. Said telescoping support members 25 will each be of a length such that, when in the telescoped-to-the-closed position, the height of the working floor 50 will be sufficiently low as to provide a roadable trailerable rig base 1/working floor 50 package. In the extended mode, however, said support members 25 should provide sufficient clearance under the working floor 50 as to allow adequate space for well head equipment, blowout preventer stacks and the like.

Figure 3:
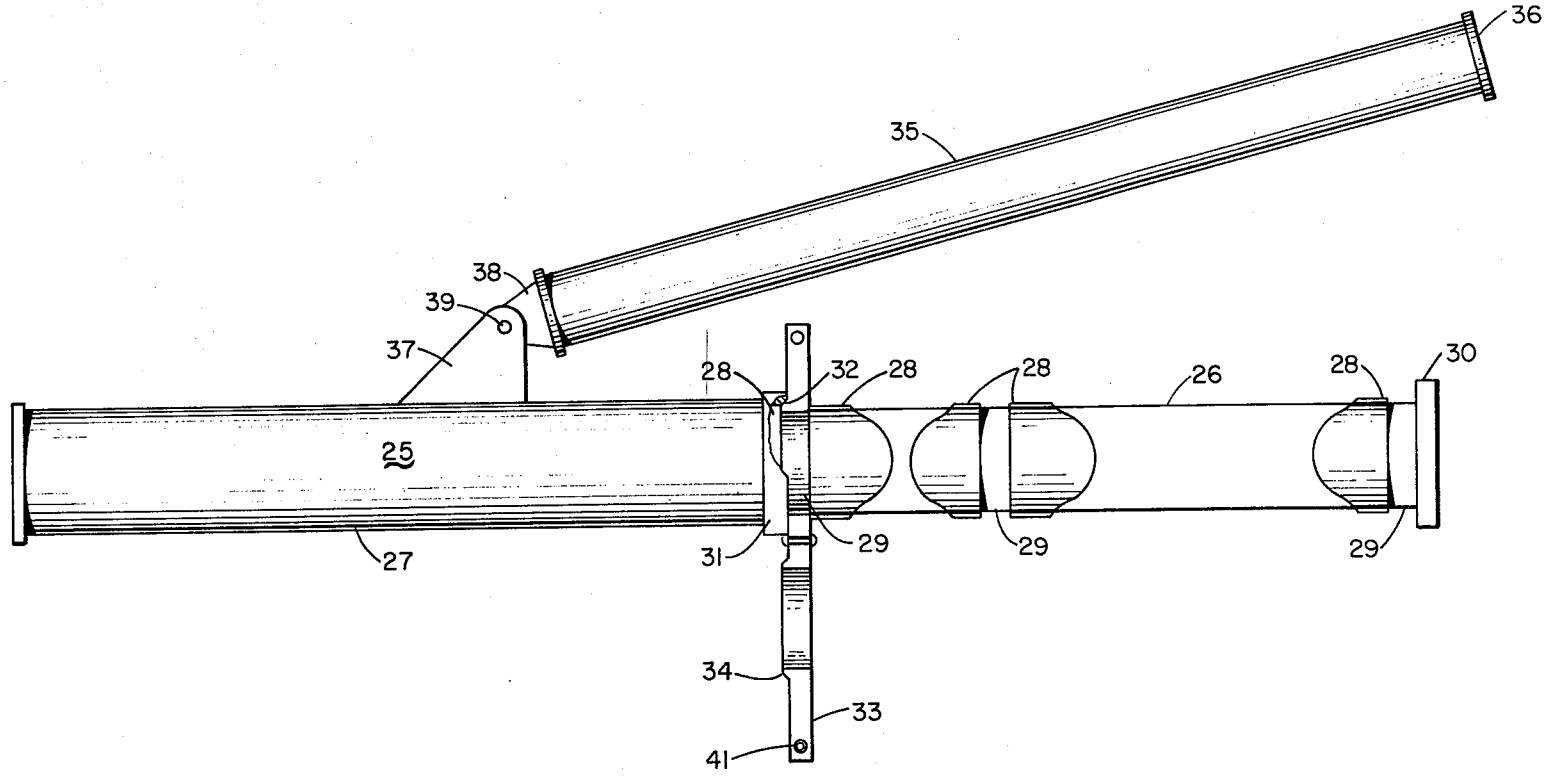
FIG. 3 is a schematic, diagrammatic side view of a suitable telescoping support member assembly for use in supporting the working floor of the drill rig above the rig base.

The telescoping support members 25 can generally be of tube-within-a-tube construction. Referring now specifically to FIG. 3, one suitable telescoping number 25 arrangement comprises a lower tubular support member 26 having a sufficiently smaller overall outside diameter as to form a nesting sliding relationship with the bore of upper tubular support member 27. As specifically shown, lower tubular support member 26 provides for multiple-position telescoping of the assembly. Each position, except the lowermost, is achieved by means of pairs of support plates 28 each of which is welded to the member 26 in spaced relationship to its respective cooperative partner thereby to form locking ring recesses 29 therebetween. The lowermost locking ring recess 29 is defined between a single support plate 28 and leg end 30 of the lower support leg member 26. The open end of upper tubular support member 27 has welded thereto a locking ring 31 having a chamfered female terminus 32. In erection operations, therefore, working floor 50 will be hoisted, jacked or otherwise suitably raised so as to telescope each upper tubular support member 27 outwardly from its corresponding inner tubular support member 26 to a point where the locking ring 31 is disposed somewhat above the desired locking ring recess 29. A cooperative split ring 33 is nested in the locking ring recess 29 and is securely clamped in position about lower support leg member 26 such as by transverse bolt means 41. As shown, said split ring 33 comprises an upwardly directed externally tapered protrusion 34 adapted to mate with the female chamfered terminus 32 of locking ring 31. After securing a split ring 33 to each of the lower tubular support members 26 of the telescoping support member array for working floor 50, said working floor 50 is lowered so as to butt the locking rings 31 of the upper tubular support members 27 against their corresponding split rings 33. It is in the nature of things that the downward force generated by the weight of working floor 50 on each upper tubular support member 27 tends to wedge its chamfered terminus 32 against protrusion 34 of corresponding split ring 33 thereby even further jamming the split ring 33 into its locking recess 29 and providing an overall support arrangement of superior security.

An important safety device which may be beneficially employed in relation to the telescoping support members 25 resides in the provision of a drop-leg safety support member 35 pivotally attached to the side of at least two diagonally opposed upper tubular support members 27. In raising of the working floor 50 to its operating position above rig base 1, there will occur the telescoping of each support member 25 to its extended position. This motion, then, will cause the upper support member 27 to translate to a position further from the rig base 1 than when the telescoping support members are in their retracted or telescoped-to-the-closed position. Thus, as said upper support member 27 is translated away from the surface of rig base 1, the free end 36 of the drop-leg safety support member 35 will tend to fall to the vertical position. By appropriately sizing the length of the drop-leg member 35, said vertical position will be attained when the locking ring 31 of upper tubular support member 27 is disposed somewhat above its corresponding locking ring recess 29. Under these conditions, then, should failure of the hoist or jack mechanism employed to raise the working floor 50 occur, the free end 36 of drop-leg safety support member 35 jams against the steel plate surface of rig base 1 and maintains its associated support member 25 in the extended position for such time as is necessary to effectuate completion of securing the split ring 33 into its locking ring recess 29. As shown in the drawings, said drop-leg safety support member 35 can be of simple robust construction and can be pivotally affixed at a suitable stand-off distance from the upper support member 27 by means of a simple clevis arrangement whereby support member 27 is provided with a pair of spaced apart vertically oriented brackets 37 defining a clevis stirrup therebetween and wherein the upper end of the drop-leg safety support member 35 is provided with a flat 38 adapted to nest between brackets 37. A clevis pin 39 inserted through aligned apertures provided in brackets 37 and flat 38 completes the pivotal fixation of the safety support member 35 to the upper support member 27.

As will be noted, it is desirable that each telescoping tubular support member 25 of the invention be arranged so that the uppermost tubular support member 27 thereof be of larger diameter and the lowermost tubular support member 26 be of smaller diameter. This arrangement mitigates against the entry of drilling muds and other foreign matter into the support member during operations, which entry might otherwise tend to clog, corrode and foul the telescoping support member assembly.

Further, it is generally desirable that the substructure assembly of the invention comprise a set-back working floor 51 coextensive with the working floor 50 and located on the V-door side thereof. It is also desirable that said set-back working floor 51 find its ground support from a set-back rig base section 4, also located on the V-door side of the rig base 1 and substantially coextensive with rig base 1. Said set-back working floor 51 can conveniently be of somewhat lighter overall construction than the main working floor 50 since it is not normally subjected to the substantial weight load of the mast assembly. Thus, set-back working floor 51 can generally be erected and secured to the main working floor 50 subsequent to raising and securing of the main working floor 50. Suitable vertical and diagonal support members 52 are employed to stabilize the set-back floor 51 over the set-back rig base section 4.

Completing the general matter of the working floors 50 and 51 there will be provided in the floor 50, positioned over the well hole, a rotary table 53. Also, set-back floor 51 will generally have located at a convenient position thereon at least one source of winching power, such as a cathead or, preferably, as depicted, a handling winch 54. Desirably, said handling winch 54 is of a hydraulic type and derives its hydraulic power from a hydraulic power package 55, which package 55 can also be conveniently and beneficially employed to provide substantially all hydraulic power which may be required during erection and operations of the drill rig assembly of the invention.

An important feature of the substructure assembly of the invention resides in the provision of at least two sturdy bracing elements 56 extending diagonally upwardly from the rig base extension 5, located on the drawworks side of the rig, to the reinforcing structure of the drawworks side of working floor 50. Each diagonal bracing element 56 comprises a sturdy beam which is desirably equipped with means to adjust the overall length thereof. As shown, said adjustment means can conveniently take the form of a jackscrew 59 interposed between beam sections 57 and 58. Desirably, for purposes of maximum bend strength and easy adjustment, lower beam section 58 will be considerably shorter than upper beam section 57, thereby to locate the jackscrew means 59 towards the lower end of the bracing element 56.

In a preferred embodiment of the invention, a pair of parallel bracing elements 56 will be located so as to equidistantly bracket the longitudinal axis of rig base extension 5 and will be spaced sufficiently apart from one another so as to accept the trailer or self-propelled drawworks/rotary table power group therebetween. Additionally, said pair of parallel spaced diagonal braces 56 will each have secured along the top surface thereof a mast guide rail 60, thereby to define a mastway extending diagonally upwardly from the rig base section 5 to working floor 50. As will be discussed in more detail hereinafter, the provision of said mastway provides for convenient erection and securing of the mast assembly to the working floor 50.

Several important functions are served by the diagonal bracing elements 56. Firstly, where it is difficult to provide a well site of substantially perfect grading, the lengths of the respective diagonal bracing elements 56 may be severally adjusted so as to provide competent support of the working floor 50 by rig base 1 taken in conjunction with rig base extension 5. Secondly, it is often the case that during operations of a drill rig the well site will settle in a non-uniform manner, thereby causing a reduction in ground support of the rig. Employing the preferred adjustable-length bracing elements 56 of the invention the detrimental affects of such non-uniform site settlement can generally be largely vitiated. Finally, said diagonal bracing elements 56, in consort with rig base 1, provide wind load protection to the drill rigs of the invention. Generally speaking, a drill rig is subjected to wind loads directed both towards and away from the drawworks side of the rig. Apparently, this is due to the fact that the made-up drill pipe sections racked on the V-door side of the mast present a relatively large overall surface to the prevailing winds. Thus, the wind forces generated thereagainst are transmitted through the mast into the supporting structure therefor. In the present invention the diagonal bracing elements 56 supply bracing effect against wind loadings applied in the direction of the drawworks side of the rig. Under these conditions, said loadings urge the rig towards the drawworks side, thus placing the bracing elements 56 in compression working against the substantial support provided by the rig base extension 5. On the other hand, when the wind loads are applied away from the drawworks side and towards the V-door side of the rig, bracing elements 56 are placed in tension thereby tending to raise the rig base extension 5. In operations, of course, the rig base extension 5 will have stationed thereon a mobile drawworks and rotary table power group unit, thereby to increase the overall weight of rig base extension 5 and to result in stability of the drill rig assembly of the invention to wind loads directed away from the drawworks side of the rig.

An important feature of the working floor 50 of the present invention resides in the provision thereon, on the drawworks side thereof, of trunnion means 61, which trunnion means 61 are adapted to mate in pivotal engagement with cooperative engagement means provided at the lower ends of the drawworks side leg members of the base mast section. Further details concerning the structure and operations of said trunnion means 61 will appear hereinafter.

Figure 4A:
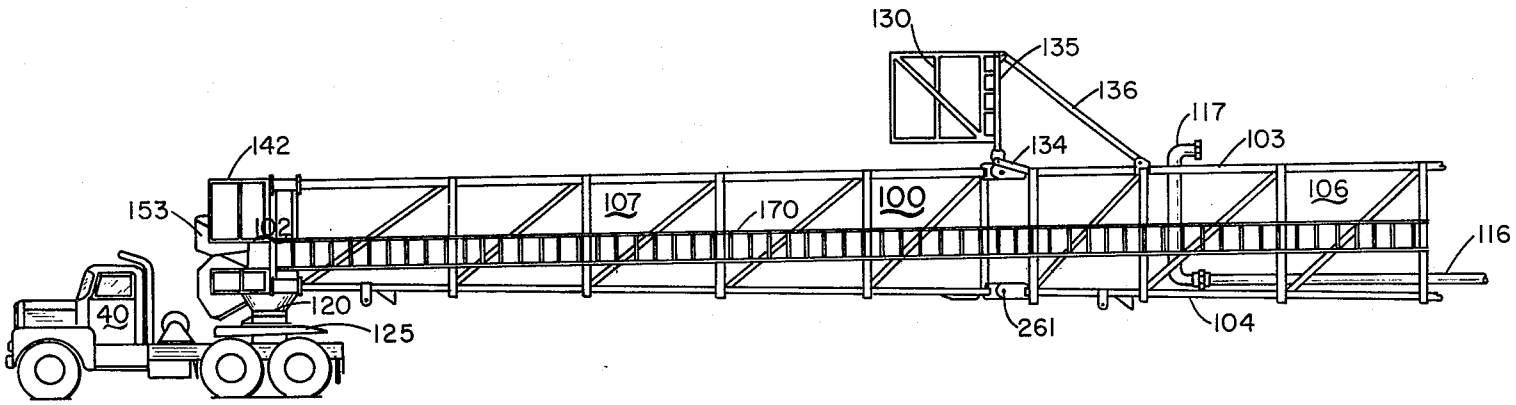
FIGS. 4A and 4B are schematic, diagrammatic side views of the trailered telescoping mast assembly of the invention shown in the extended condition and temporarily secured to the rig base extension.
Figure 4B:
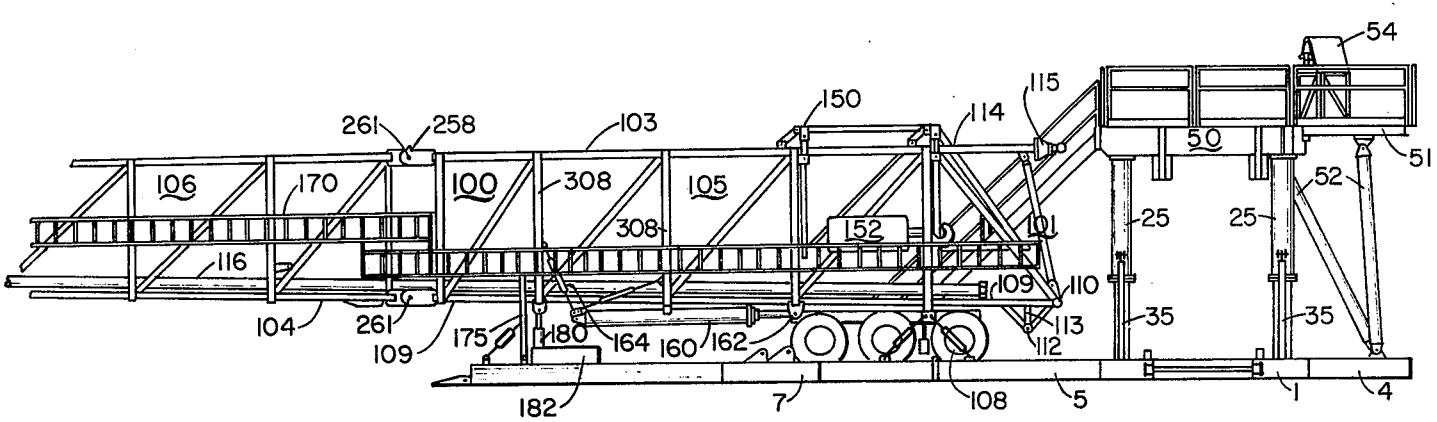

The mast assembly of the invention, referring now specifically to FIGS. 4A and 4B, broadly comprises a sectional telescoping mast 100 having legs broadly defining the four corners thereof and which legs extend in a generally convergent manner from the base 101 to the crown 102 of the mast. As is conventional in drill rig mast construction, one side of the mast assembly of the present invention is essentially free of girts or other impedimentia thereacross, thereby providing an open or "V"-door side 103 through which drill pipe is brought to the interior of the mast assembly for positioning over the well hole. In the drill rig assembly of the present invention the mast 100 is adapted for trailering in the telescoped-to-the-closed condition with the V-door side 103 thereof oriented to the top. Accordingly, the drawworks side of the mast assembly 100, in other words the closed side 104 opposite the V-door side 103, is adapted for engagement with a suitable trailering device. Thus, drawworks side 104 of base mast section 105 is adapted for temporary mounting on a suitable bogie 108 while the drawworks side 104 of crown mast section 107 is equipped with suitable kingpin means 120 adapted for engagement thereof with a fifth wheel means 125 of tractor vehicle 40. Of course, as a suitable alternative, now shown, the kingpin/fifth wheel arrangement may be reversed, the kingpin being located on the tractor vehicle and the fifth wheel being located on the drawworks side of crown 102 of the crown mast section 107.

At a suitable height above the base 101 of base mast section 105 there is provided on the V-door side 103 of the mast assembly 100 a racking board 130 which is pivotally mounted on the V-door side of the mast. Said pivotal mounting can take the form of bracket means 134 which are pivotally pinned to the inboard ends of floor members 135 of the racking board 130. The racking board 130 is braced in the erected position by means of brace members 136 which are pinned at their respective ends to the outboard ends of floor members 135 and to the V-door side mast legs. When the mast assembly 100 is in the telescoped-to-the-closed condition preparatory to roading thereof, said racking board 130 can be readily and desirably nested over crown 102 by unpinning or removal of brace members 136, thereby to allow the racking board to pivot about brackets 134. This is highly desirable, of course, since it minimizes the roading height of the overall mast assembly while maintaining the racking board 130 in an easily and rapidly erectable condition.

Desirably, the base mast section 105 of the mast assembly 100 will be provided with a removable cradle 150 adapted to secure and hold travelling block 152 therein during trailering of the rig and erection of the mast. While, of course, the travelling block 152 may be secured in any other suitable fashion, the provision of cradle 150 markedly eases this burden and protects the structural elements of the mast assembly from damage during transit.

Also, during trailering each drawworks side leg 109 of the base mast section 105 preferably carries thereon a hydraulic raising ram 160 pivotally affixed at one working end thereof to a mast jacking point 162. In the trailered condition, the other end of each hydraulic raising ram 160 is suitably shackled, in the retracted condition, to the base mast section 105. Said shackling can be accomplished such as by means of turnbuckles 164 suitably affixed to nearby girt members 308.

The mast assembly 100 is further desirably equipped with a ladderway 170 running from the base 101 thereof to the crow's nest 142 of crown 102. Desirably, said ladderway 170 will be of the swing-away type, adapted to nest closely to the side of the mast sections during roading and telescoping thereof while being capable of being swung away from said mast so as to lie parallel to the side of the mast at a suitable stand-off distance therefrom. This capability can be achieved by fixation of the respective sections of ladderway 170 to the mast sections 105, 106 and 107 by means of pivotal parallelogram linkages 171, which linkages are shown in detail in FIG. 8.

Figure 5:
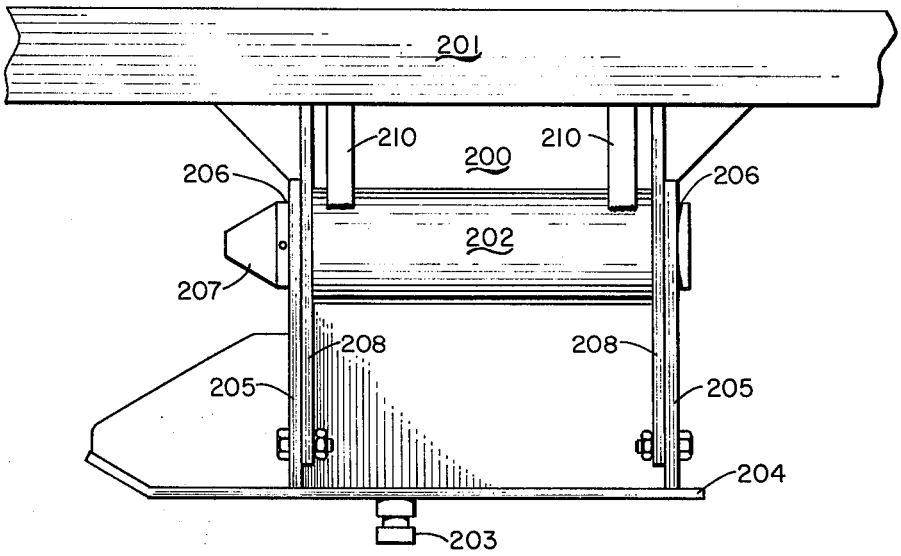
FIG. 5 is a schematic, diagrammatic side view of a preferred kingpin arrangement whereby the crown mast section of the mast assembly is secured to the fifth wheel of a tractor vehicle.
Figure 6:
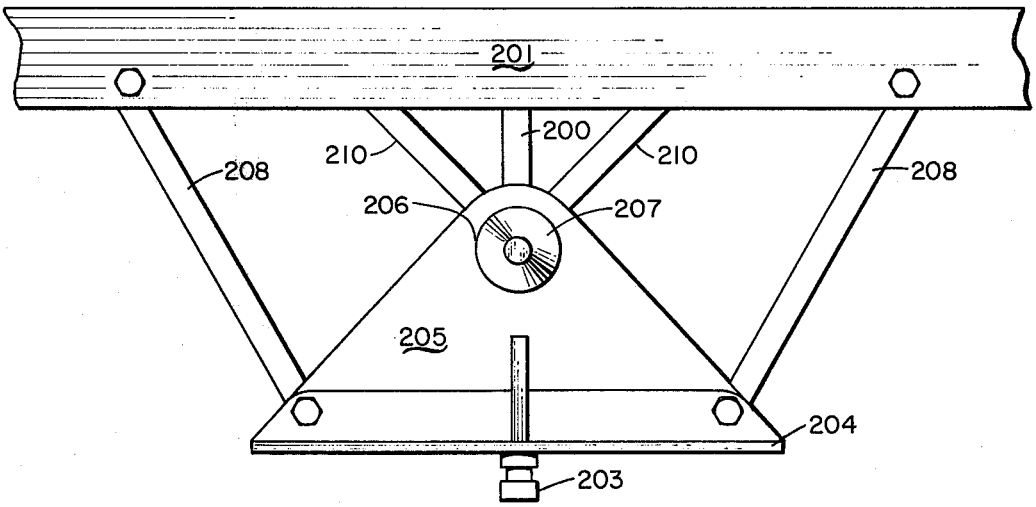
FIG. 6 is a schematic, diagrammatic front view of the kingpin assembly of FIG. 5.

In telescoping of the mast assembly of the invention, whether to the extended or retracted condition, it is important that the mast sections 105, 106 and 107 not be torqued or twisted to such an extent, relative to one another, that binding or substantial distortion thereof occur. Accordingly, an important preferred embodiment of the trailerable telescoping mast assembly of the invention resides in a provision made to mitigate against the occurrence of detrimental twisting of the mast sections during telescoping thereof. Accordingly, referring now specifically to FIGS. 5 and 6, there is shown in detail a particular kingpin arrangement comprising a substantial support web 200 which depends vertically from and is fixed at its upper margin to the water table beams 201 of the crown 102. Said web 200 is reinforced by means of diagonal bracing elements 210 which extend diagonally upwardly from the bottom of web 200 and are welded to the lateral aspects of the water table beams 201. Welded to the bottom margin of said web 200 is a bushing or journal 202 which is oriented parallel to the longitudinal axis of crown mast section 107. Kingpin 203 is fixedly mounted to and depends from a substantial horizontal kingpin plate 204 having inverted "V"-shaped reinforcing endplates 205 welded thereto. In turn, said inverted V-plates 205 have co-aligned apertures 206 therethrough and are spaced sufficiently from one another as to allow nesting thereof over the ends of bushing or journal 202, A pin 206 traverses the apertures 206 of the endplates 205 and the bushing 202, thereby completing the longitudinally articulated linkage of kingpin 203 to the crown 102 of mast assembly 100. Thus, when telescoping the mast assembly of the invention, the usual perturbations of grading at the well site are isolated from the crown section 107 and are not transmitted thereto through the tractor vehicle 40 and the fifth wheel 125/kingpin assembly 120 linkage as would normally be the case in employing fifth wheel/kingpin linkages conventional in the art. On the other hand, it is generally undesirable to allow freedom of roll motion of the load during roading of the mast assembly 100. Accordingly, the kingpin assembly of the invention includes removable diagonal bracing elements 208 which are removably pinned or bolted at their respective ends to the base of the inverted endplates 205 and to water table beams 201. In this manner, rolling motion of the mast load about pin 207 is prevented during roading while allowing the rolling articulation to be quickly and desirably recovered during telescoping operations merely by removal of diagonal bracing elements 208.

Features of base mast section 105 of mast assembly 100 (FIGS. 4A and 4B) include the provision of trunnion engaging means 110 at the base of each drawworks side leg member 109, said engaging means, of course, being adapted to engage in vertically pivotal relationship with their corresponding trunnion blocks 61 of the working floor 50. As shown more particularly in FIG. 11, said trunnion engaging means 110 can take the simple form of pipe-shaped members 111 affixed to the bottom of each drawworks side mast section leg member 109, each said member 111 being oriented with its bore axis directed across the drawworks side of the mast assembly. It will be apparent, however, that many other equivalent structures capable of performing similar pivotal attachment functions can be employed in lieu of the specific members 111 depicted in the drawings. For instance, parallel clevis plate arrangements having coaxially aligned clevis pin apertures therethrough can also be suitably employed.

Figure 9:
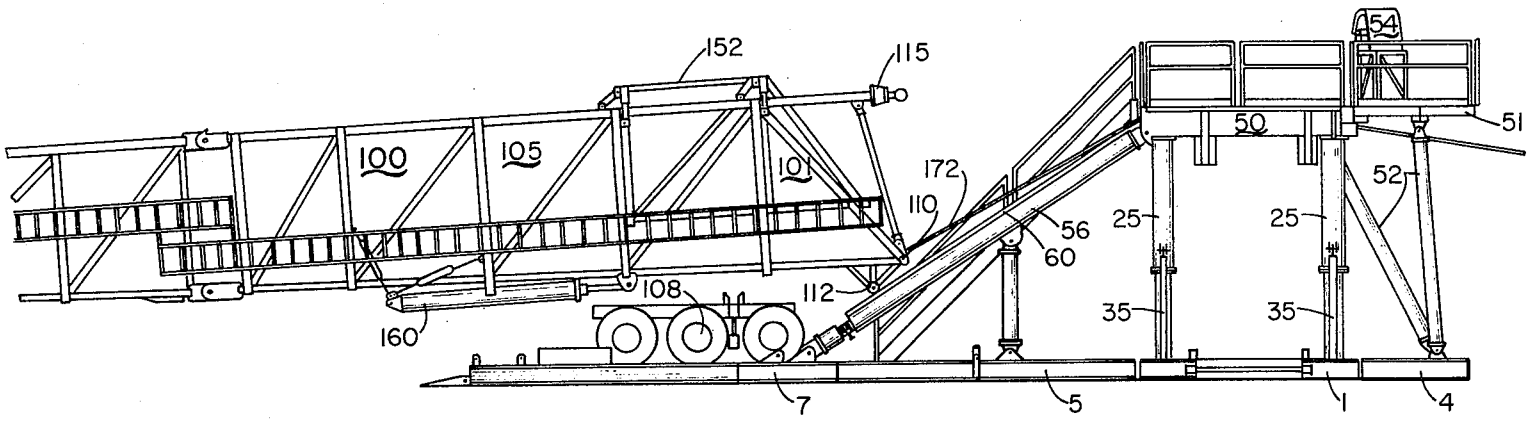
FIG. 9 is a diagrammatic, schematic side view of the trailered extended mast assembly of the invention after partial tracking of the base mast section thereof to the working floor of the drill rig.
Figure 10:
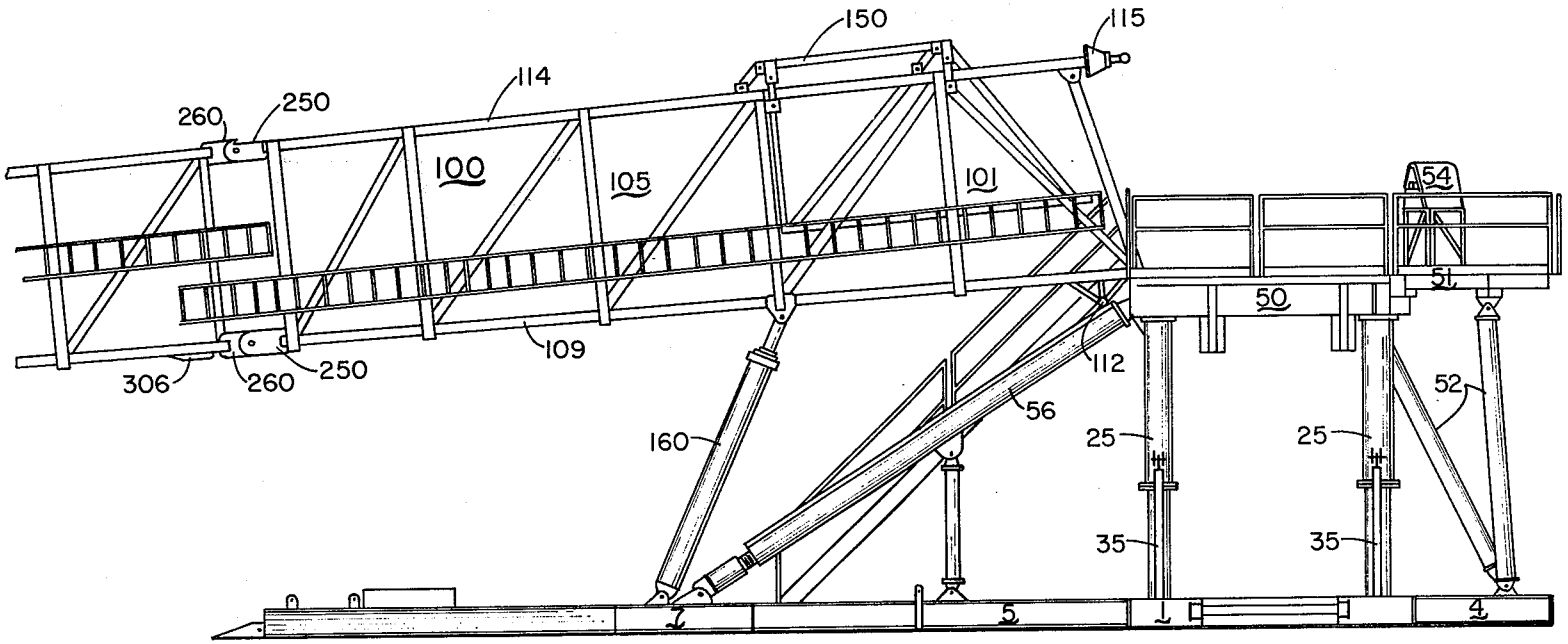
FIG. 10 is a diagrammatic, schematic side view of the drill rig after complete tracking of the base mast section to the working floor of the drill rig and also disclosing hydraulic ram means adapted to raise the mast assembly to the vertical.

The base mast section 105 is also provided with at least one pair of mast roller means 112 which extend to the drawworks side of each drawworks side base mast section leg 109. Desirably, said mast roller means 112 are mounted on a suitable truss structure 113 somewhat above the level of the pivotal engagement means 110. The distance between the roller means 112 and the centerline of base mast section leg members 109 is subject to considerable variation. However, said distance should generally be chosen so as to result in vertical alignment of the trunnion engaging means 110 with the trunnion blocks 61 when the mast is raised to the position shown in FIG. 10. It is, of course, the prime function of roller means 112 to cooperatively engage the mastway defined by parallel rails 60 and to thus facilitate the vertical and horizontal translation of the base mast section 105 from rig base extension 5 to the working floor 50 as depicted in FIGS. 9 and 10.

In another preferred embodiment of the invention, the base ends of the V-door side leg members 114 of base mast section 105 will be equipped with vertical adjustment means such as jackscrews 115. This, of course, provides for independent vertical adjustment of each said V-door side mast leg, thus facilitating plumbing of the mast assembly after raising to the vertical and during rig operations.

In yet another preferred embodiment of the invention, the mast 100 will be trailered with a mudpipe or standpipe 116 affixed thereto. Accordingly, the standpipe 116 is attached in swiveling relationship to one of the corners of the drawworks side of the base mast section 105. During trailering of the mast assembly 100, the gooseneck 117 of standpipe 116 will be secured to the side of the mast. However, during mast extension and retraction, said gooseneck 117 will be swung away from the side of the mast in order to provide sufficient clearance thereof from the mast sections, thus to avoid interference therewith.

An important feature residing in the mast assembly 100 specifically disclosed in the drawings forming part hereof resides in the provision of concentric positioning of the mast leg members of each mast section with respect to corresponding mast leg members of the neighboring mast section(s). This feature, of course, provides for straight-line transfer of load throughout the assembled mast leg members, which feature contributes greatly to the achievement of maximum structural strength rigidity and integrity and which feature is not known to be achieved in prior art telescoping mast arrangements.

Figure 8:
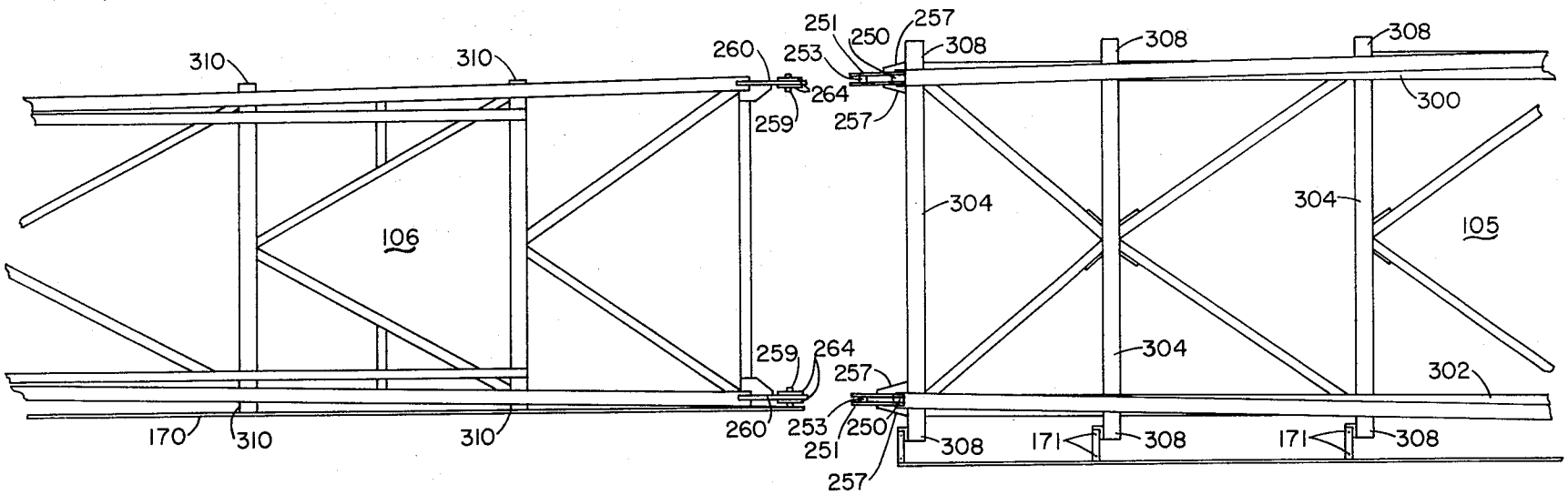
FIG. 8 is a diagrammatic, schematic top view of the mast sections of FIG. 7.
Figure 7:
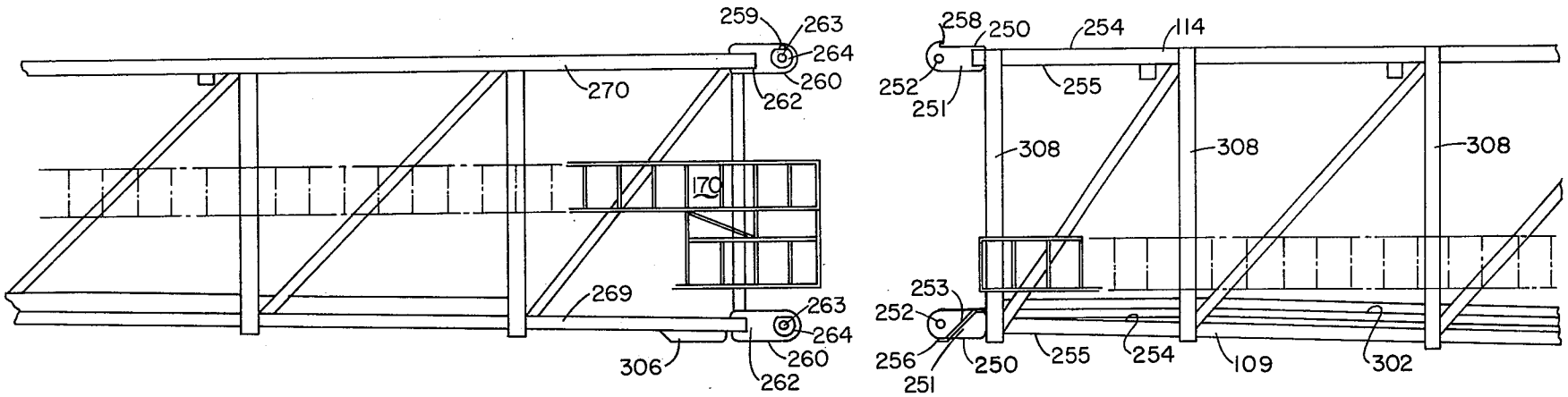
FIG. 7 is a diagrammatic, schematic side view of portions of two typical mast sections adapted for mating to one another in a manner such that there is provided concentric positioning and loading of the mast leg members from one mast section to the next.

While the following discussion specifically illustrates concentric positioning of the corresponding leg members of the base and intermediate mast sections 105 and 106, respectively, it will, of course, be obvious that similar means are employed to join intermediate mast section 106 to the crown mast section 107. Referring, then, especially to FIGS. 7 and 8, the upper ends of the drawworks side mast leg members 109 and V-door side mast leg members 114 are each equipped with female pin connector brackets 250. Each said female pin connector bracket 250 comprises a pair of mast connector side plates 251 in spaced, parallel relationship to one another and which plates are secured to the end of their associated mast leg member equidistantly to either side of the centerline thereof. Coaxially aligned mast connector pin apertures 252 are provided through each pair of side plates 251, each said aperture 252 also being located on the extended centerline of its associated mast leg member 109 or 114. Completing the broad features of female pin connector brackets 250 there is provided between each pair of side plates 251 a generally downwardly directed slide ramp/spacer element 253, the upper edge of which is coextensive with its associated mast section guide rail 300 or 302. For purposes of rendering a clear understanding of the slide ramp/spacer elements 253 of female pin connector brackets 250 the drawworks side pin connector bracket 250 of FIG. 7 is shown absent the exteriormost sideplate 251 thereof, thereby to expose slide ramp/-spacer element 253 thereof. It will be understood, therefore, that in actual practice said exteriormost sideplate 251 will be present.

Said ramp/spacer elements 253 than course diagonally downwardly to a level somewhat below the drawworks side surfaces 255 of the ends of their corresponding mast leg members. Each slide ramp/spacer element 253 terminates in a short substantially horizontal section 256. Desirably, the sideplates 251 of the female pin connector brackets 250 are reinforced, such as by means of gussets 256. An important preferred embodiment of the female pin connector brackets resides in the conformation of at least those of the side plates 251 associated with the V-door side leg members 114. As will be noted in FIG. 7, the uppermost edges of said V-door mast leg member side plates 251 extend for a short distance from the end of the mast leg member in a substantially horizontal manner and are then sharply and concavely radiused upwardly to define stop notches 258. Said notches 258, in combination with cooperative stop pins 259 of male connector brackets 260 located on the ends of the V-door mast leg members 270 of mast section 106, serve to prevent accidental hyperextension of the respective mast sections 105 and 106 and also serve to closely position the respective pin connector brackets for insertion of the connector pins 261 (FIG. 4). If desired, of course, the drawworks side brackets 250 and 260 may also be similarly equipped.

The lower ends of the drawworks side and V-door side mast leg members 269 and 270, respectively, of mast section 106 are each provided with a male connector bracket 260. Each said male connector bracket 260 broadly comprises a sturdy plate element 262 which defines an extension of the centerline of its associated mast leg member 269 or 270 and which plate element 262 comprises a connector pin aperture 263 therethrough, said aperture also being located on the extended centerline of the particular mast leg member associated therewith. Desirably, said aperture 263 is reinforced such as by welding to each side thereof an annular reinforcing/spacing member 264 which serves not only to reinforce the aperture 263 but also functions as to provide a nicety of fit of the male connector bracket 260 into its respective female connector bracket 250. In completing the assembly of mast section 106 to mast section 105, it will, of course, be obvious that the aligned apertures 252 and 263 of each set of mated female and male bracket members 250 and 260 receive a close fitting connector pin therethrough, which pin may be appropriately saftied after insertion thereof.

The means employed to cooperatively nest the respective mast sections 105, 106 and 107 within one another are also shown in FIGS. 7 and 8. Said means include parallel mast section guide rails 300 and 302 which are located on the inside surfaces of the drawworks side girts 304 of the larger mast section and which guide rails are spaced sufficiently apart as to accept in engaging relationship therewith corresponding rub members 306 which extend outwardly to the drawworks side of the drawworks side mast leg members 269 of the next smaller mast section 106. Importantly, it is to be noted that the widths across the interiors of the several side girts 308 of the larger mast section 105 are greater than the largest widths taken across the exteriors of the several side girts 310 of the next smaller mast section 106. Said rub members 306 should extend sufficiently to the drawworks side of the drawworks side leg members 269 as to maintain the male pin connector brackets 260 of the drawworks side mast leg members 269 out of contact with guide rails 300 and 302 during retraction and extension of the mast section 106 within the larger base mast section 105. Thus, just prior to seating of the respective male and female pin connectors 260 and 250 one within the other during mast extension, said rub members 306 will bias the lower end of mast section 106 upwardly with respect to the upper end of mast section 105 so as to position the lower margins of the plate elements 262 of male pin connector brackets 260 just above the ramp/-spacer element 253 of the female pin connector brackets 250. Upon further outward extension of the mast section 106 from mast section 105, of course, said plate elements 262 will initially contact the mast leg member end portions of the ramp/spacer elements 253, thereafter to be guided downwardly and to result in vertical alignment of the apertures 263 and 252 in preparation for pinning of the respective aligned pin connector arrangements so as to secure mast section 106 to mast section 105.

In setting up for the extension of the mast assembly 100, the trailered mast assembly is first backed onto the rig base extension 5 so as to position bogie 108 substantially as shown in FIGS. 4A and 4B. The bogie 108 is then secured to the rig base extension 5 in order to prevent movement thereof during extension of the mast assembly. By means of suitable auxiliary hoisting equipment, such as a truck mounted gin pole hoist, the reserve line spool 190 which resides within the retracted mast assembly during trailering thereof is removed and positioned on the ground substantially as shown in the plan view of FIG. 2. Said reserve line spool 190, of course, serves to store excess travelling block cable which results from retraction of the mast assembly into its trailerable condition. Next, the racking board 130 is erected by pivoting thereof about the V-door side brackets 134 thereof and securing bracing elements 136 thereto and to the V-door side of the mast. Bracing elements 208 (FIGS. 5 and 6) are removed from the kingpin assembly 120, thereby to isolate the crown mast section 102 from twisting loads which might otherwise be imposed thereon by the tractor vehicle 40 operating over non-uniform terrain at the well site. Desirably, there are also erected from the rig base extension 5 vertical stop members 175, located to either side of the trailered mast assembly 100 and which members 175 serve to limit side play of said mast assembly during extension and retraction thereof by the tractor vehicle 40.

During extension and retraction of the mast assembly 100, a pair of hydraulic manipulating cylinders 180 are pivotally attached at their respective ends to rig base extension 5 and to the drawworks side mast leg members 109 of base mast section 105. Said manipulating cylinders 180 are employed independently of one another and serve to support and maintain longitudinal alignment of the respective mast sections 105, 106 and 107 as said sections are extended or retracted by driving the tractor vehicle 40 away from or towards the drawworks side of the rig. Said manipulating cylinders 180, therefore, also serve to adjust and maintain the longitudinal alignment of the respective mast sections despite grade changes which the tractor vehicle 40 may experience during the extension or retraction of the mast assembly. When not in use, the manipulating cylinders 180 may be conveniently stored, while maintaining their respective attachments to the rig base extension 5, by provision of storage boxes 182 which are integral with the rig base extension 5.

Desirably, snubbing cables (not shown) are temporarily installed between the mast sections during extension of the mast assembly as the respective mast sections approach the intended limits of their traverse, said snubbing cables serving as secondary safetying devices to prevent hyperextension of the mast sections and accidental complete withdrawal of a smaller mast section from its next larger mast section.

As the respective mast sections are withdrawn during extension of the mast assembly, travelling block cable stored on reserve line spool 190 is payed out, thereby preserving the rigged and strung up condition of the travelling block 152 and crown block 153. As the male pin connector brackets 260 of each mast section are appropriately juxtaposed with their corresponding female pin connector brackets 250 of the adjacent lower mast section, said brackets are pinned together and safetied. As shown in FIGS. 4A and 4B, the completion of the extension of the mast assembly 100 will result in a full-length mast structure lying substantially horizontally, V-door side up, said mast assembly 100 being supported by bogie 108, manipulating cylinders 180 and tractor vehicle 40.

Next, bogie 108 is unshackled from rig base extension 5, the manipulating cylinders 180 unsecured from their attach points on mast section 105 and the mast assembly moved so as to allow installation of diagonal bracing elements 56 and to engage mast rollers 112 thereof with their corresponding mast guide rails 60. The base mast section 105 is unsecured from bogie 108 and a pair of drawlines 172 are secured to suitable haul points on each side of the base mast section 105. By suitable winch means, not shown, in combination with rearward movement of the tractor vehicle 40, the base section 105 of mast assembly 100 is moved upwardly on rails 60 towards the working floor 50. FIG. 9 shows an intermediate position of the mast 100 during this procedure and, as will be noted, the upwardly directed translation of the base mast section 105 as it traverses up the rails 60 disengages it from bogie 108.

Figure 11:
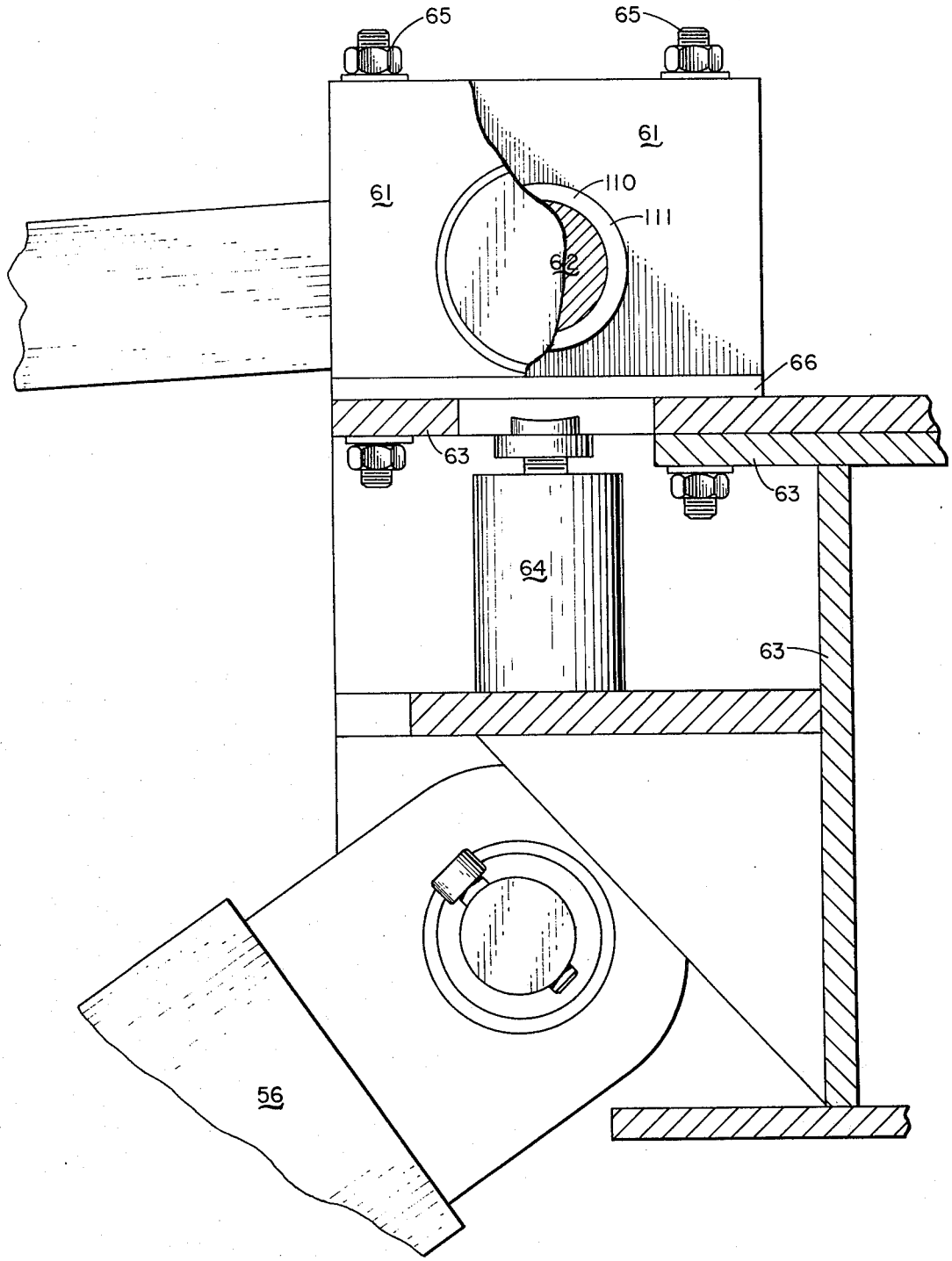
FIG. 11 is a diagrammatic, schematic, partially sectional view of a portion of the working floor of the drill rig of the invention showing the pivotal engagement of the base mast section leg members to the trunnion means of the working floor. In addition.

FIGS. 10 and 11 show the base mast section 105 raised to the level of working floor 50 with the trunnion engaging means 110 of mast leg members 109 engaged with their cooperative trunnion means 61 by means of pins 62. Also, the raising rams 160 are attached to the rig base extension 5.

In a preferred embodiment of the invention, the trunnion means 61 will be securely bolted to reinforcing members 63 of the drawworks side of the working floor 50. Positioned therebeneath will be provided hydraulic jack means 64. By this arrangement there is provided the capability of independent vertical adjustment of each of the drawworks side mast legs 109. This independent vertical adjustment, in combination with independent horizontal adjustment as provided by drawlines 172, allows ready alignment of the engaging means 110 with trunnion 61. Such independent vertical adjustment may also be required, from time to time, during the course of well drilling operations when settlement of the drill rig may occur. Accordingly, in vertically adjusting the drawworks side mast legs 109, the bolt means 65 are loosened and the entire trunnion assembly comprising trunnion means 61, trunnion engaging means 110 and pin 62 is raised to the desired height by jack means 64. The trunnion means 61 are then shimmed, such as by means of shim plate 66, and the bolt means 65 are torqued down to complete the adjustment procedure.

Having erected mast base section 105 to the working floor 50 and having secured engaging means 110 of leg members 109 thereof to the trunnion means 61, the kingpin 120/fifth wheel 125 assembly is disengaged and the mast assembly 100 raised to the vertical through the action of raising rams 160 which may each be of multi-stage, double-acting type. Obviously, lowering the mast from the vertical will also be accomplished by reversing the actions of said raising rams. The raising of mast assembly 100 is completed by securing the ends of V-door side mast leg members 114 in any suitable manner to the working floor 50.

Figure 12:
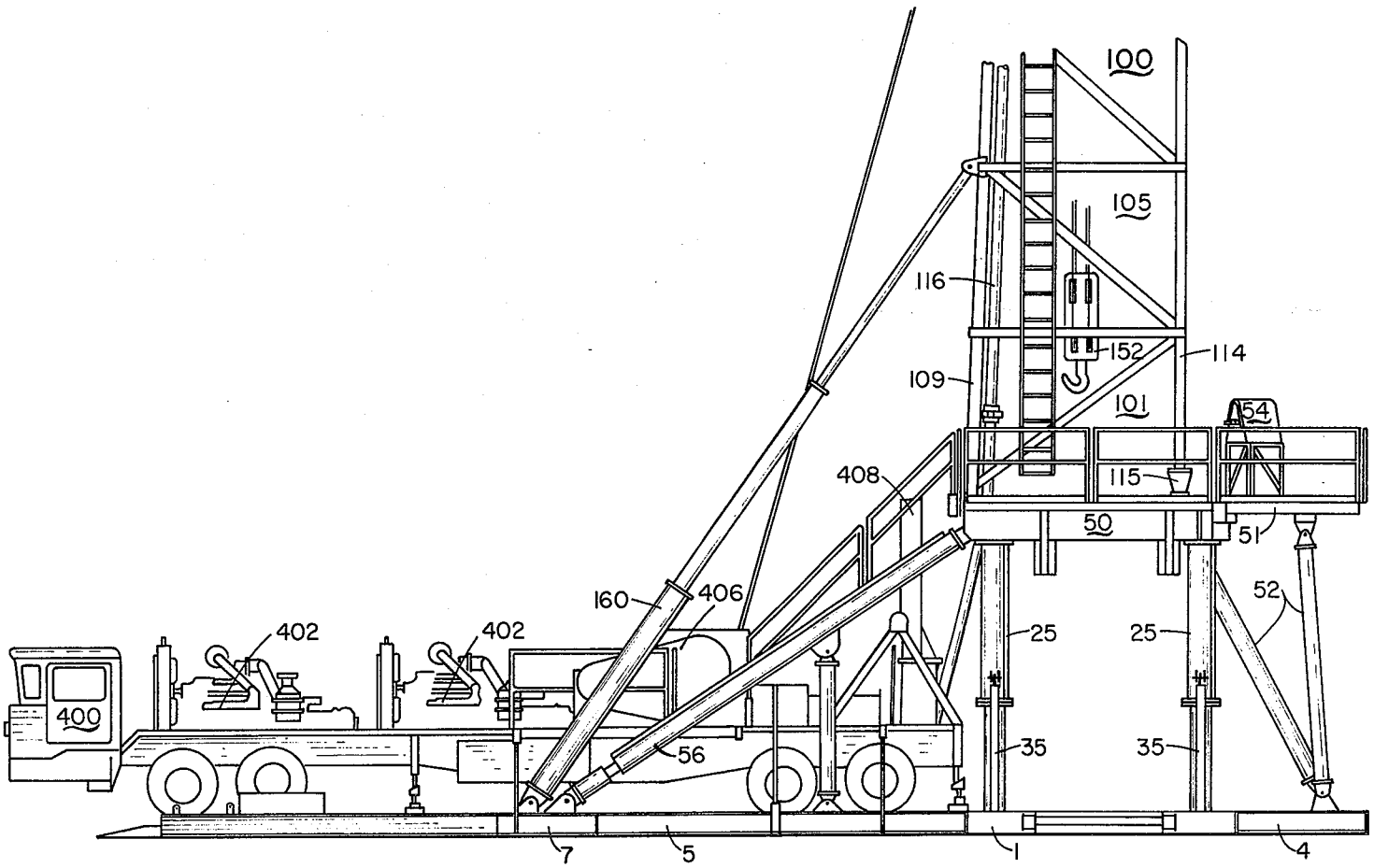
FIG. 12 is a diagrammatic, schematic side view of the drill rig of the invention showing the mast assembly thereof in the vertical position and a self-propelled drawworks and rotary table power group located at its operating station on the rig base extension.

Completing the drill rig of the invention (FIG. 12), a self-propelled or trailerable drawworks and rotary table power group 400 is backed into position on the rig base extension 5, said group comprising one or more prime movers 402, deck mounted drawworks 406 and a rotary table drive train 408 which is coupled into the rotary table 53 of the working floor 50. Said drawworks power group 400 may also include a mudpump drive (not shown). Such mobile roadable drawworks/rotary table power groups are known in the art and are exemplified by units such as the Cabot 900 Series Drilling Rig produced by Cabot Corporation, Machinery Division, Pampa, Texas. The free end of the travelling block cable is attached to the drawworks 406 and the cable going to the reserve line spool 190 is anchored to a suitable deadline anchor (not shown), said anchor preferably being located on working floor 50. After tautening of the cable, the travelling block cradle 150 is removed from the mast assembly 100, thereby freeing travelling block 152 to hang from the crown block 153. The mast assembly 100 is then brought into plumb by adjustment of jackscrew means 115 of the V-door mast leg members 114 and/or by adjustment of the height of the drawworks side trunnion assemblies as described previously.

Obviously, disassembly of the drill rig of the invention will involve essentially the reverse procedure of the assembly schedule outlined above.

It should be noted that the several specific embodiments of the invention specifically described hereinbefore are to be considered in all respects as illustrative and not limiting, and all changes coming within the meaning and equivalency range of the appended claims are intended to be embraced therein.

What is claimed is:

1. A mobile drill rig apparatus comprising:

A. a rig base having a drawworks side and, opposite thereto, a V-door side;

B. a working floor adapted for erection in spaced relationship above said rig base by means of a plurality of freely slidable and lockable support members stationed therebetween, said working floor comprising a rotary table and, located on the drawworks side of said floor, trunnion means;

C. a rig base extension extending from the drawworks side of said rig base and separable therefrom, said rig base extension defining a ground-based platform of a size and shape adapted for stationing the roadable mast assembly of (E) thereon during erection and takedown of the mast assembly and for stationing a drawworks/rotary table power group thereon during drilling operations;

D. at least two diagonal bracing elements each secured at one end thereof to said rig base extension and, at the other end thereof, to the erected working floor of (B);

E. a roadable telescoping mast assembly composed of mast sections including a base mast section and a crown mast section, said mast assembly having four leg members extending in a substantially mutually convergent manner from the base to the crown thereof, said leg members defining the four corners of the mast assembly; said mast assembly having a V-door side and, opposite thereto, a drawworks side; said mast assembly being adapted for roading thereof in the retracted condition and in a substantially horizontal position with the V-door side thereof up; the lower ends of the drawworks side mast leg members of said base mast section being equipped with trunnion engaging means adapted to engage said trunnion means of the working floor of (B) in substantially vertically pivotal relationship;

F. means to raise the base mast section of the roadable mast assembly of (E) from its horizontal position located on the rig base extension of (C) to the erected working floor of (B) and means to bring said trunnion engaging means into engagement with said trunnion means of said working floor; and G. mast raising means located on the drawworks side of the rig assembly to raise the mast assembly of (E) to the vertical on the working floor of (B).

2. The drill rig apparatus of claim 1 wherein said plurality of telescoping support members, in the retracted condition, provide a working floor/rig base assembly of a height sufficiently low as to be trailerable as a single package.

3. The drill rig apparatus of claim 1 wherein each said telescoping support member comprises a relatively larger diameter upper tubular member and a relatively smaller diameter lower tubular member, said tubular members being adapted to nest one over the other in telescoping relationship, and means to lock said larger and smaller tubular members together.

4. The drill rig apparatus of claim 1 wherein at least two diagonally opposed tubular support members each has affixed thereto a drop-leg safety support member of a length adapted to drop to the vertical and to position the free end thereof just above the surface of said rig base when said working floor is erected to a height slightly greater than the working height thereof above said rig base.

5. A mobile drill rig apparatus comprising:

A. a rig base having a drawworks side and, opposite thereto, a V-door side;

B. a working floor adapted for erection in spaced relationship above said rig base, said working floor comprising a rotary table and, located on the drawworks side of said floor, trunnion means;

C. a rig base extension extending from the drawworks side of said rig base and separable therefrom, said rig base extension defining a ground-based platform of a size and shape adapted for stationing the roadable mast assembly of (E) thereon during erection and takedown of the mast assembly and for stationing a drawworks/rotary table power group thereon during drilling operations, said rig base extension comprising parallel guideways spaced as to engage the tires of self-propelled or trailered vehicles and thereby position same on the extension;

D. at least two diagonal bracing elements each secured at one end thereof to said rig base extension and, at the other end thereof, to the erected working floor of (B);

E. a roadable telescoping mast assembly composed of mast sections including a base mast section and a crown mast section, said mast assembly having four leg members extending in a substantially mutually convergent manner from the base to the crown thereof, said leg members defining the four corners of the mast assembly; said mast assembly having a V-door side and, opposite thereto, a drawworks side; said mast assembly being adapted for roading thereof in the retracted condition and in a substantially horizontal position with the V-door side thereof up; the lower ends of the drawworks side mast leg members of said base mast section being equipped with trunnion engaging means adapted to engage said trunnion means of the working floor of (B) in substantially vertically pivotal relationship;

F. means to raise the base mast section of the roadable mast assembly of (E) from its horizontal position located on the rig base extension of (C) to the erected working floor of (B) and means to bring said trunnion engaging means into engagement with said trunnion means of said working floor; and G. mast raising means located on the drawworks side of the rig assembly to raise the mast assembly of (E) to the vertical on the working floor of (B).

6. A mobile drill rig apparatus comprising:

A. a rig base having a drawworks side and, opposite thereto, a V-door side;

B. a working floor adapted for erection in spaced relationship above said rig base, said working floor comprising a rotary table and, located on the drawworks side of said floor, trunnion means;

C. a rig base extension extending from the drawworks side of said rig base and separable therefrom, said rig base extension defining a ground-based platform of a size and shape adapted for stationing the roadable mast assembly of (E) thereon during erection and takedown of the mast assembly and for stationing a drawworks/rotary table power group thereon during drilling operations, said rig base extension comprising means to adjust the height of the base mast section of the substantially horizontal telescoping mast assembly of (E) stationed thereon during extension and retraction;

D. at least two diagonal bracing elements each secured at one end thereof to said rig base extension and, at the other end thereof, to the erected working floor of (B);

E. a roadable telescoping mast assembly composed of mast sections including a base mast section and a crown mast section, said mast assembly having four leg members extending in a substantially mutually convergent manner from the base to the crown thereof, said leg members defining the four corners of the mast assembly; said mast assembly having a V-door side and, opposite thereto, a drawworks side; said mast assembly being adapted for roading thereof in the retracted condition and in a substantially horizontal position with the V-door side thereof up; the lower ends of the drawworks side mast leg members of said base mast section being equipped with trunnion engaging means adapted to engage said trunnion means of the working floor of (B) in substantially vertically pivotal relationship;

F. means to raise the base mast section of the roadable mast assembly of (E) from its horizontal position located on the rig base extension of (C) to the erected working floor of (B) and means to bring said trunnion engaging means into engagement with said trunnion means of said working floor; and G. mast raising means located on the drawworks said of the rig assembly to raise the mast assembly of (E) to the vertical on the working floor of (B).

7. The drill rig apparatus of claim 1 wherein said adjustment means comprise a pair of independently controllable manipulating hydraulic cylinders each attached at one working end thereof to said rig base extension and which cylinders are adapted to be attached at their respective other working ends to each side of the base mast section of said telescoping mast assembly.

8. A mobile drill rig apparatus comprising:

A. a rig base having a drawworks side and, opposite thereto, a V-door side;

B. a working floor adapted for erection in spaced relationship above said rig base, said working floor comprising a rotary table and, located on the drawworks side of said floor, trunnion means;

C. a rig base extension extending from the drawworks side of said rig base and separable therefrom, said rig base extension defining a ground-based platform of a size and shape adapted for stationing the roadable mast assembly of (E) thereon during erection and takedown of the mast assembly and for stationing a drawworks/rotary table power group thereon during drilling operations, said rig base extension being provided with at least one pair of vertically oriented stop means located to either side of a roadable mast assembly stationed thereon, said stop means being adapted to limit side play of said mast assembly during extension or retraction thereof;

D. at least two diagonal bracing elements each secured at one end thereof to said rig base extension and, at the other end thereof, to the erected working floor of (B);

E. a roadable telescoping mast assembly composed of mast sections including a base mast section and a crown mast section, said mast assembly having four leg members extending in a substantially mutually convergent manner from the base to the crown thereof, said leg members defining the four corners of the mast assembly; said mast assembly having a V-door side and, opposite thereto, a drawworks side; said mast assembly being adapted for roading thereof in the retracted condition and in a subtantially horizontal position with the V-door side thereof up; the lower ends of the drawworks side mast leg members of said base mast section being equipped with trunnion engaging means adapted to engage said trunnion means of the working floor of (B) in substantially vertically pivotal relationship;

F. means to raise the base mast section of the roadable mast assembly of (E) from its horizontal position located on the rig base extension of (C) to the erected working floor of (B) and means to bring said trunnion engaging means into engagement with said trunnion means of said working floor; and G. mast raising means located on the drawworks side of the rig assembly to raise the mast assembly of (E) to the vertical on the working floor of (B).

9. A mobile drill rig apparatus comprising:

A. a rig base having a drawworks side and, opposite thereto, a V-door side, said rig base comprising a trackway embracing the well hole site thereof, said trackway extending laterally or to the V-door side of said well hole site and a blowout preventer dolly adapted for stationing on said trackway;

B. a working floor adapted for erection in spaced relationship above said rig base, said working floor comprising a rotary table and, located on the drawworks side of said floor, trunnion means;

C. a rig base extension extending from the drawworks side of said rig base and separable therefrom, said rig base extension defining a ground-based platform of a size and shape adapted for stationing the roadable mast assembly of (E) thereon during erection and takedown of the mast assembly and for stationing a drawworks/rotary table power group thereon during drilling operations;

D. at least two diagonal bracing elements each secured at one end thereof to said rig base extension and, at the other end thereof, to the erected working floor of (B);

E. a roadable telescoping mast assembly composed of mast sections including a base mast section and a crown mast section, said mast assembly having four leg members extending in a substantially mutually convergent manner from the base to the crown thereof, said leg members defining the four corners of the mast assembly; said mast assembly having a V-door side and, opposite thereto, a drawworks side; said mast assembly being adapted for roading thereof in the retracted condition and in a subtantially horizontal position with the V-door side thereof up; the lower ends of the drawworks side mast leg members of said base mast section being equipped with trunnion engaging means adapted to engage said trunnion means of the working floor of (B) in substantially vertically pivotal relationship;

F. means to raise the base mast section of the roadable mast assembly of (E) from its horizontal position located on the rig base extension of (C) to the erected working floor of (B) and means to bring said trunnion engaging means into engagement with said trunnion means of said working floor; and G. mast raising means located on the drawworks side of the rig assembly to raise the mast assembly of (E) to the vertical on the working floor of (B).

10. A mobile drill rig apparatus comprising:

A. a rig base having a drawworks side and, opposite thereto, a V-door side;

B. a working floor adapted for erection in spaced relationship above said rig base, said working floor comprising a rotary table and, located on the drawworks side of said floor, trunnion means;

C. a rig base extension extending from the drawworks side of said rig base and separable therefrom, said rig base extension defining a ground-based platform of a size and shape adapted for stationing the roadable mast assembly of (E) thereon during erection and takedown of the mast assembly and for stationing a drawworks/rotary table power group thereon during drilling operations;

D. at least two diagonal adjustable-length bracing elements each secured at one end thereof to said rig base extension and, at the other end thereof, to the erected working floor of (B);

E. a roadable telescoping mast assembly composed of mast sections including a base mast section and a crown mast section, said mast assembly having four leg members extending in a substantially mutually convergent manner from the base to the crown thereof, said leg members defining the four corners of the mast assembly; said mast assembly having a V-door side and, opposite thereto, a drawworks side; said mast assembly being adapted for roading thereof in the retracted condition and in a substantially horizontal position with the V-door side thereof up; the lower ends of the drawworks side mast leg members of said base mast section being equipped with trunnion engaging means adapted to engage said trunnion means of the working floor of (B) in substantially vertically pivotal relationship;

F. means to raise the base mast section of the roadable mast assembly of (E) from its horizontal position located on the rig base extension of (C) to the erected working floor of (B) and means to bring said trunnion engaging means into engagement with said trunnion means of said working floor; and G. mast raising means located on the drawworks side of the rig assembly to raise the mast assembly of (E) to the vertical on the working floor of (B).

11. The drill rig apparatus of claim 10 wherein said adjustable length bracing element comprises a relatively longer upper beam section and a relatively substantially shorter lower beam section and jackscrew means interposed therebetween.

12. A mobile drill rig apparatus comprising:

A. a rig base having a drawworks side and, opposite thereto, a V-door side;

B. a working floor adapted for erection in spaced relationship above said rig base, said working floor comprising a rotary table and, located on the drawworks side of said floor, trunnion means;

C. a rig base extension extending from the drawworks side of said rig base and separable therefrom, said rig base extension defining a ground-based platform of a size and shape adapted for stationing the roadable mast assembly of (E) thereon during erection and takedown of the mast assembly and for stationing a drawworks/rotary table power group thereon during drilling operations;

D. at least two diagonal parallel bracing elements spaced equidistantly to each side of the longitudinal axis of said rig base extension, each said element being secured at one end thereof to said rig base extension and, at the other end thereof, to the erected working floor of (B) and each said bracing element having a mast guide rail along the upper surface thereof;

E. a roadable telescoping mast assembly composed of mast sections including a base mast section and a crown mast section, said mast assembly having four leg members extending in a substantially mutually convergent manner from the base to the crown thereof, said leg members defining the four corners of the mast assembly; said mast assembly having a V-door side and, opposite thereto, a drawworks side; said mast assembly being adapted for roading thereof in the retracted condition and in a substantially horizontal position with the V-door side thereof up; the base mast section comprising mast roller means adapted to cooperatively engage with said mast guide rails of (D) and the lower ends of the drawworks side mast leg members of said base mast section being equipped with trunnion engaging means adapted to engage said trunnion means of the working floor of (B) in substantially vertically pivotal relationship;

F. means to raise the base mast section of the roadable mast assembly of (E) from its horizontal position located on the rig base extension of (C) to the erected working floor of (B) and means to bring said trunnion engaging means into engagement with said trunnion means of said working floor; and G. mast raising means located on the drawworks side of the rig assembly to raise the mast assembly of (E) to the vertical on the working floor of (B).

13. A mobile drill rig apparatus comprising:

A. a rig base having a drawworks side and, opposite thereto, a V-door side;

B. a working floor adapted for erection in spaced relationship above said rig base, said working floor comprising a rotary table and, located on the drawworks side of said floor, trunnion means;

C. a rig base extension extending from the drawworks side of said rig base and separable therefrom, said rig base extension and said rig base together defining a T-shaped planform, said rig base extension constituting the leg of the T, and said rig base extension defining a ground-based platform of a size and shape adapted for stationing the roadable mast assembly and for stationing a drawworks/rotary table power group thereon during drilling operations;

D. at least two diagonal bracing elements each secured at one end thereof to said rig base extension and, at the other end thereof, to the erected working floor of (B);

E. a roadable telescoping mast assembly composed of mast sections including a base mast section and a crown mast section, said mast assembly having four leg members extending in a substantially mutually convergent manner from the base to the crown thereof, said leg members defining the four corners of the mast assembly; said mast assembly having a V-door side and, opposite thereto, a drawworks side; said mast assembly being adapted for roading thereof in the retracted condition and in a substantially horizontal position with the V-door side thereof up; the lower ends of the drawworks side mast leg memebers of said base mast section being equipped with trunnion engaging means adapted to engage said trunnion means of the working floor of (B) in substantially vertically pivotal relationship;

F. means to raise the base mast section of the roadable mast assembly of (E) from its horizontal position located on the rig base extension of (C) to the erected working floor of (B) and means to bring said trunnion engaging means into engagement with said trunnion means of said working floor; and G. mast raising means located on the drawworks side of the rig assembly to raise the mast assembly of (E) to the vertical on the working floor of (B).

14. A mobile drill rig apparatus comprising:

A. a rig base having a drawworks side, and, opposite thereto, a V-door side, said rig base additionally comprising a set-back rig base coextensive therewith and extending to the V-door side of the rig;

B. a working floor adapted for erection in spaced relationship above said rig base, said working floor comprising a rotary table, trunnion means located on the drawworks side of said floor and a separable set-back working floor coextensive with said working floor and extending to the V-door side of the rig, said set-back working floor being supported by means of a plurality of support members interposed between said set-back rig base and said set-back working floor;

C. a rig base extension extending from the drawworks side of said rig base and separable therefrom, said rig base extension defining a ground-based platform of a size and shape adapted for stationing the roadable mast assembly of (E) thereon during erection and takedown of the mast assembly and for stationing a drawworks/rotary table power group thereon during drilling operations;

D. at least two diagonal bracing elements each secured at one end thereof to said rig base extension and, at the other end thereof, to the erected working floor of (B);

E. a roadable telescoping mast assembly composed of mast sections including a base mast section and a crown mast section, said mast assembly having four leg members extending in a substantially mutually convergent manner from the base to the crown thereof, said leg members defining the four corners of the mast assembly; said mast assembly having a V-door side and, opposite thereto, a drawworks side; said mast assembly being adapted for roading thereof in the retracted condition and in a substantially horizontal position with the V-door side thereof up; the lower ends of the drawworks side mast leg members of said base mast section being equipped with trunnion engaging means adapted to engage said trunnion means of the working floor of (B) in substantially vertically pivotal relationship;

F. means to raise the base mast section of the roadable mast assembly of (E) from its horizontal position located on the rig base extension of (C) to the erected working floor of (B) and means to bring said trunnion engaging means into engagement with said trunnion means of said working floor; and G. mast raising means located on the drawworks side of the rig assembly to raise the mast assembly of (E) to the vertical on the working floor of (B).

15. The drill rig apparatus of claim 14 wherein said set-back working floor is provided with at least one handling winch means.

16. The drill rig apparatus of claim 15 wherein said winch means is hydraulically powered.

17. A mobile drill rig apparatus comprising:

A. a rig base having a drawworks side and, opposite thereto, a V-door side;

B. a working floor adapted for erection in spaced relationship above said rig base, said working floor comprising a rotary table and, located on the drawworks side of said floor, trunnion means;

C. a rig base extension extending from the drawworks side of said rig base and separable therefrom, said rig base extension defining a ground-based platform of a size and shape adapted for stationing the roadable mast assembly of (E) thereon during erection and takedown of the mast assembly and for stationing a drawworks/rotary table power group thereon during drilling operations;

D. at least two diagonal bracing elements each secured at one end thereof to said rig base extension and, at the other end thereof, to the erected working floor of (B);

E. a roadable telescoping mast assembly composed of mast sections including a base mast section and a crown mast section, said mast assembly having four leg members extending in a substantially mutually convergent manner from the base to the crown thereof, said leg members defining the four corners of the mast assembly; said mast assembly having a V-door side and, opposite thereto, a drawworks side; said mast assembly being adapted for roading thereof in the retracted condition and in a substantially horizontal position with the V-door side thereof up; the lower ends of the drawworks side mast leg members of said base mast section being equipped with trunnion engaging means adapted to engage said trunnion means of the working floor of (B) in substantially vertically pivotal relationship;

F. means to raise the base mast section of the roadable mast assembly of (E) from its horizontal position located on the rig base extension of (C) to the erected working floor of (B) and means to bring said trunnion engaging means into engagement with said trunnion means of said working floor; and G. mast raising means to raise the mast assembly of (E) to the vertical on the working floor of (B), said mast raising means comprising a pair of hydraulic ram means, each said hydraulic ram means having a working attachment at one end thereof to the drawworks side of the base mast section of said mast assembly and having a working attachment at the other end thereof to said rig base extension.

18. The drill rig apparatus of claim 17 wherein said hydraulic ram raising means are attached at one end thereof to their respective working attach points of the drawworks side of the base mast section of the mast assembly and wherein said base mast section is provided with means adapted to secure the other ends of said hydraulic ram raising means to the drawworks side of said base mast section during roading thereof.

19. The drill rig apparatus of claim 17 wherein each said hydraulic raising ram means is of a multi-stage, double-acting type.

20. A mobile drill rig apparatus comprising:

A. a rig base having a drawworks side and, opposite thereto, a V-door side;

B. a working floor adapted for erection in spaced relationship above said rig base, said working floor comprising a rotary table and, located on the drawworks side of said floor, trunnion means;

C. a rig base extension extending from the drawworks side of said rig base and separable therefrom, said rig base extension defining a ground-based platform of a size and shape adapted for stationing the roadable mast assembly of (E) thereon during erection and takedown of the mast assembly and for stationing a drawworks/rotary table power group thereon during drilling operations;

D. at least two diagonal bracing elements each secured at one end thereof to said rig base extension and, at the other end thereof, to the erected working floor of (B);

E. a roadable telescoping mast assembly composed of mast sections including a base mast section and a crown mast section, said mast assembly having four leg members extending in a substantially mutually convergent manner from the base to the crown thereof, said leg members defining the four corners of the mast assembly; said mast assembly having a V-door side and, opposite thereto, a drawworks side; said mast assembly being adapted for roading thereof in the retracted condition and in a substantially horizontal position with the V-door side thereof up, said adaption for roading including a kingpin or fifth wheel assembly located on the drawworks side of said crown and being adapted for cooperative engagement with a corresponding fifth wheel or kingpin arrangement of a tractor vehicle and a detachable bogie secured to said base mast section; the lower ends of the drawworks side mast leg members of said base mast section being equipped with trunnion engaging means adapted to engage said trunnion means of the working floor of (B) in substantially vertically pivotal relationship;

F. means to raise the base mast section of the roadable mast assembly of (E) from its horizontal position located on the rig base extension of (C) to the erected working floor of (B) and means to bring said trunnion engaging means into engagement with said trunnion means of said working floor; and G. mast raising means located on the drawworks side of the rig assembly to raise the mast assembly of (E) to the vertical on the working floor of (B).

21. The drill rig apparatus of claim 20 wherein said kingpin or fifth wheel assembly of said crown is adapted for temporary articulation about the roll axis of the telescoping mast assembly load during extension and retraction thereof.

22. A mobile drill rig apparatus comprising:

A. a rig base having a drawworks side and, opposite thereto, a V-door side;

B. a working floor adapted for erection in spaced relationship above said rig base, said working floor comprising a rotary table and, located on the drawworks side of said floor, trunnion means;

C. a rig base extension extending from the drawworks side of said rig base and separable therefrom, said rig base extension defining a ground-based platform of a size and shape adapted for stationing the roadable mast assembly of (E) thereon during erection and takedown of the mast assembly and for stationing a drawworks/rotary table power group thereon during drilling operations;

D. at least two diagonal bracing elements each secured at one end thereof to said rig base extension and, at the other end thereof, to the erected working floor of (B);

E. a roadable telescoping mast assembly composed of mast sections including a base mast section and a crown mast section, said mast assembly having four leg members extending in a substantially mutually convergent manner from the base to the crown thereof, said leg members defining the four corners of the mast assembly; said mast assembly having a V-door side and, opposite thereto, a drawworks side; said mast assembly being adapted for roading thereof in the retracted condition and in a substantially horizontal position with the V-door side thereof up; the lower ends of the drawworks side mast leg members of said base mast section being equipped with trunnion engaging means adapted to engage said trunnion means of the working floor of (B) in substantially vertically pivotal relationship and said mast assembly comprising a racking board, located on the V-door side, adapted to pivot and nest over the crown of the retracted mast assembly, F. means to raise the base mast section of the roadable mast assembly of (E) from its horizontal position located on the rig base extension of (C) to the erected working floor of (B) and means to bring said trunnion engaging means into engagement with said trunnion means of said working floor; and G. mast raising means located on the drawworks side of the rig assembly to raise the mast assembly of (E) to the vertical on the working floor of (B).

23. A mobile drill rig apparatus comprising:

A. a rig base having a drawworks side and, opposite thereto, a V-door side;

B. a working floor adapted for erection in spaced relationship above said rig base, said working floor comprising a rotary table and, located on the drawworks side of said floor, trunnion means;

C. a rig base extension extending from the drawworks side of said rig base and separable therefrom, said rig base extension defining a ground-based platform of a size and shape adapted for stationing the roadable mast assembly of (E) thereon during erection and takedown of the mast assembly and for stationing a drawworks/rotary table power group thereon during drilling operations;

D. at least two diagonal bracing elements each secured at one end thereof to said rig base extension and, at the other end thereof, to the erected working floor of (B);

E. a roadable telescoping mast assembly composed of mast sections including a base mast section and a crown mast section, said mast assembly having four leg members extending in a substantially mutually covergent manner from the base to the crown thereof, said leg members defining the four corners of the mast assembly; said mast assembly having a V-door side and, opposite thereto, a drawworks side; said mast assembly being adapted for roading thereof in the retracted condition and in a substantially horizontal position with the V-door side thereof up; the lower ends of the drawworks side mast leg members of said base mast section being equipped with trunnion engaging means adapted to engage said trunnion means of the working floor of (B) in substantially vertically pivotal relationship;

F. means to raise the base mast section of the roadable mast assembly of (E) from its horizontal position located on the rig base extension of (C) to the erected working floor of (B) and means to bring said trunnion engaging means into engagement with said trunnion means of said working floor;

G. mast raising means located on the drawworks side of the rig assembly to raise the mast assembly of (E) to the vertical on the working floor of (B); and H. a removable travelling block cradle adapted to nest in the base section of said mast assembly in the retracted condition thereof.

24. A mobile drill rig apparatus comprising:

A. a rig base having a drawworks side and, opposite thereto, a V-door side;

B. a working floor adapted for erection in spaced relationship above said rig base, said working floor comprising a rotary table and, located on the drawworks side of said floor, trunnion means;

C. a rig base extension extending from the drawworks side of said rig base and separable therefrom, said rig base extension defining a ground-based platform of a size and shape adapted for stationing the roadable mast assembly of (E) thereon during erection and takedown of the mast assembly and for stationing a drawworks/rotary table power group thereon during drilling operations;

D. at least two diagonal bracing elements each secured at one end thereof to said rig base extension and, at the other end thereof, to the erected working floor of (B);

E. a roadable telescoping mast assembly composed of mast sections including a base mast section and a crown mast section, said mast assembly having four leg members extending in a substantially mutually convergent manner from the base to the crown thereof, said leg members defining the four corners of the mast assembly; said mast assembly having a V-door side and, opposite thereto, a drawworks side; said mast assembly being adapted for roading thereof in the retracted condition and in a substantially horizontal position with the V-door side thereof up; the lower ends of the drawworks side mast leg members of said base mast section being equipped with trunnion engaging means adapted to engage said trunnion means of the working floor of (B) in substantially vertically pivotal relationship;

F. means to raise the base mast section of the roadable mast assembly of (E) from its horizontal position located on the rig base extension of (C) to the erected working floor of (B) and means to bring said trunnion engaging means into engagement with said trunnion means of said working floor;

G. mast raising means located on the drawworks side of the rig assembly to raise the mast assembly of (E) to the vertical on the working floor of (B); and H. a reserve travelling block cable spool means adapted to nest into the V-door side of said mast assembly in the retracted condition thereof.

25. A mobile drill rig apparatus comprising:

A. a rig base having a drawworks side and, opposite thereto, a V-door side;

B. a working floor adapted for erection in spaced relationship above said rig base, said working floor comprising a rotary table and, located on the drawworks side of said floor, trunnion means;

C. a rig base extension extending from the drawworks side of said rig base and separable therefrom, said rig base extension defining a ground-based platform of a size and shape adapted for stationing the roadable mast assembly of (E) thereon during erection and takedown of the mast assembly and for stationing a drawworks/rotary table power group thereon during drilling operations;

D. at least two diagonal bracing elements each secured at one end thereof to said rig base extension and, at the other end thereof, to the erected working floor of (B);

E. a roadable telescoping mast assembly composed of mast sections including a base mast section and a crown mast section, said mast assembly having four leg members extending in a substantially mutually convergent manner from the base to the crown thereof, said leg members defining the four corners of the mast assembly; said mast assembly comprising a ladderway from the base to the crown thereof, said ladderway being pivotally attached to the mast sections to station said ladderway adjacent the respective mast sections during retraction, roading and extension of the mast assembly and to swing away in a parallel manner from said mast sections upon extension and raising of the mast assembly to the vertical on the working floor of the rig; said mast assembly having a V-door side and, opposite thereto, a drawworks side; said mast assembly being adapted for roading thereof in the retracted condition and in a substantially horizontal position with a V-door side thereof up; the lower ends of the drawworks side mast leg members of said base mast section being equipped with trunnion engaging means adapted to engage said trunnion means of the working floor of (B) in substantially vertically pivotal relationship;

F. means to raise the base mast section of the roadable mast assembly of (E) from its horizontal position located on the rig base extension of (C) to the erected working floor of (B) and means to bring said trunnion engaging means into engagement with said trunnion means of said working floor; and G. mast raising means located on the drawworks side of the rig assembly to raise the mast assembly of (E) to the vertical on the working floor of (B).

26. A mobile drill rig apparatus comprising:

A. a rig base having a drawworks side and, opposite thereto, a V-door side;

B. a working floor adapted for erection in spaced relationship above said rig base, said working floor comprising a rotary table and, located on the drawworks side of said floor, trunnion means;

C. a rig base extension extending from the drawworks side of said rig base and separable therefrom, said rig base extension defining a ground-based platform of a size and shape adapted for stationing the roadable mast assembly of (E) thereon during erection and takedown of the mast assembly and for stationing a drawworks/rotary table power group thereon during drilling operations;

D. at least two diagonal bracing elements each secured at one end thereof to said rig base extension and, at the other end thereof, to the erected working floor of (B);

E. a roadable telescoping mast assembly composed of mast sections including a base mast section and a crown mast section, said mast assembly having four leg members extending in a substantially mutually convergent manner from the base to the crown thereof, said leg members defining the four corners of the mast assembly; said mast assembly having a V-door side and, opposite thereto, a drawworks side; said mast assembly being adapted for roading thereof in the retracted condition and in a substantially horizontal position with the V-door side thereof up; said base mast section having affixed near one of the corners thereof and in swiveling relationship thereto a standpipe equipped at its top with a gooseneck and means to secure said gooseneck adjacent said mast assembly during roading thereof; the lower ends of the drawworks side mast leg members of said base mast section being equipped with trunnion engaging means adapted to engage said trunnion means of the working floor of (B) in substantially vertically pivotal relationship;

F. means to raise the base mast section of the roadable mast assembly of (E) from its horizontal position located on the rig base extension of (C) to the erected working floor of (B) and means to bring said trunnion engaging means into engagement with said trunnion means of said working floor; and G. mast raising means located on the drawworks side of the rig assembly to raise the mast assembly of (E) to the vertical on the working floor of (B).

27. A mobile drill rig apparatus comprising:

A. a rig base having a drawworks side and, opposite thereto, a V-door side;

B. a working floor adapted for erection in spaced relationship above said rig base, said working floor comprising a rotary table and, located on the drawworks side of said floor, trunnion means;

C. a rig base extension extending from the drawworks side of said rig base and separable therefrom said rig base extension defining a ground-based platform of a size and shape adapted for stationing the roadable mast assembly of (E) thereon during erection and takedown of the mast assembly and for stationing a drawworks/rotary table power group thereon during drilling operations;

D. at least two diagonal bracing elements each secured at one end thereof to said rig base extension and, at the other end thereof, to the erected working floor of (B);

E. a roadable telescoping mast assembly composed of mast sections including a base mast section and a crown mast section, said mast assembly having four leg members extending in a substantially mutually convergent manner from the base to the crown thereof, said leg members defining the four corners of the mast assembly; said mast assembly having a V-door side and, opposite thereto, a drawworks side; said mast assembly being adapted for roading thereof in the retracted condition and in a substantially horizontal position with the V-door side thereof up; the end of each leg member of each mast section being provided with means for establishing and maintaining straight-line concentric positioning thereof with the end of its corresponding leg member of the adjacent mast section; and the lower ends of the drawworks side mast leg members of said base mast section being equipped with trunnion engaging means adapted to engage said trunnion means of the working floor of (B) in substantially vertically pivotal relationship;

F. means to raise the base mast section of the roadable mast assembly of (E) from its horizontal position located on the rig base extension of (C) to the erected working floor of (B) and means to bring said trunnion engaging means into engagement with said trunnion means of said working floor; and G. mast raising means located on the drawworks side of the rig assembly to raise the mast assembly of (E) to the vertical on the working floor of (B).

28. A mobile drill rig apparatus comprising:

A. a rig base having a drawworks side and, opposite thereto, a V-door side;

B. a working floor adapted for erection in spaced relationship above said rig base, said working floor comprising a rotary table and, located on the drawworks side of said floor, trunnion means;

C. a rig base extension extending from the drawworks side of said rig base and separable therefrom, said rig base extension defining a ground-based platform of a size and shape adapted for stationing the roadable mast assembly of (E) thereon during erection and takedown of the mast assembly and for stationing a drawworks/rotary table power group thereon during drilling operations;

D. at least two diagonal bracing elements each secured at one end thereof to said rig base extension and, at the other end thereof, to the erected working floor of (B);

E. a roadable telescoping mast assembly composed of mast sections including a base mast section and a crown mast section, said mast assembly having four leg members extending in a substantially mutually convergent manner from the base to the crown thereof, said leg members defining the four corners of the mast assembly; said mast assembly having a V-door side and, opposite thereto, a drawworks side; said mast assembly being adapted for roading thereon in the retracted condition and in a substantially horizontal position with the V-door side thereof up; the lower ends of the drawworks side mast leg members of said base mast section being equipped with trunnion engaging means adapted to engage said trunnion means of the working floor of (B) in substantially vertically pivotal relationship; the lower ends of the V-door side mast leg members of said base mast section being equipped with means for vertical adjustment thereof with respect to said working floor;

F. means to raise the base mast section of the roadable mast assembly of (E) from its horizontal position located on the rig base extension of (C) to the erected working floor of (B) and means to bring said trunnion engaging means into engagement with said trunnion means of said working floor; and G. mast raising means located on the drawworks side of the rig assembly to raise the mast assembly of (E) to the vertical on the working floor of (B).

29. A mobile drill rig apparatus comprising:

A. a rig base having a drawworks side and, opposite thereto, a V-door side;

B. a working floor adapted for erection in spaced relationship above said rig base, said working floor comprising a rotary table and, located on the drawworks side of said floor, trunnion means;

C. a rig base extension extending from the drawworks side of said rig base and separable therefrom, said rig base extension defining a ground-based platform of a size and shape adapted for stationing the roadable mast assembly of (E) thereon during erection and takedown of the mast assembly and for stationing a drawworks/rotary table power group thereon during drilling operations;

D. at least two diagonal bracing elements each secured at one end thereof to said rig base extension and, at the other end thereof, to the erected working floor of (B);

E. a roadable telescoping mast assembly composed of mast sections including a base mast section and a crown mast section, said mast assembly having four leg members extending in a substantially mutually convergent manner from the base to the crown thereof, said leg members defining the four corners of the mast assembly; said mast assembly having a V-door side and, opposite thereto, a drawworks side; said mast assembly being adapted for roading thereof in the retracted condition and in a substantially horizontal position with the V-door side thereof up; the lower ends of the drawworks side mast leg members of said base mast section being equipped with trunnion engaging means adapted to engage said trunnion means of the working floor of (B) in substantially vertically pivotal relationship;

F. means to raise the base mast section of the roadable mast assembly of (E) from its horizontal position located on the rig base extension of (C) to the erected working floor of (B) and means to bring said trunnion engaging means into engagement with said trunnion means of said working floor;

G. mast raising means located on the drawworks side of the rig assembly to raise the mast assembly of (E) to the vertical on the working floor of (B); and H. vertical adjustment means for each drawworks side mast section leg member of said base mast section and each trunnion means of the working floor corresponding thereto.

30. The drill rig apparatus of claim 29 wherein each said vertical adjustment means comprises a hydraulic jack located on the working floor and positioned under the trunnion engaging means of its associated drawworks side base mast section leg member.

31. The drill rig apparatus of claim 28 wherein each said vertical adjustment means of (E) comprises a jackscrew.

* * * * *